US005885743A

United States Patent [19]

Takayanagi et al.

[11] Patent Number: 5,885,743

[45] Date of Patent: Mar. 23, 1999

[54] ELECTROPHOTOGRAPHIC TONER AND PROCESS FOR THE PREPARATION THEREOF

[75] Inventors: Hitoshi Takayanagi; Hiroko Sakurai, both of Chiba; Kazuo Itoya; Kinji Shinzo, both of Sakura; Yukiko Soma, Tokyo; Kenichi Hirabayashi, Warabi; Koichiro Matsuki, Sakura; Minoru Nomura, Ina-machi; Takashi Ito; Hiroyuki Ohminato, both of Tokyo, all of Japan

[73] Assignee: Dainippon Ink and Chemicals, Inc., Tokyo, Japan

[21] Appl. No.: 979,786

[22] Filed: Nov. 26, 1997

Related U.S. Application Data

[63] Continuation-in-part of Ser. No. 808,843, Feb. 28, 1997, abandoned.

[30] Foreign Application Priority Data

| | | | |
|---|---|---|---|
| Sep. 6, 1996 | [JP] | Japan | 8-236459 |
| Sep. 6, 1996 | [JP] | Japan | 8-236460 |
| Oct. 30, 1996 | [JP] | Japan | 8-288148 |
| Nov. 15, 1996 | [JP] | Japan | 8-304407 |

[51] Int. Cl.[6] ..... G03G 9/087; G03G 9/093

[52] U.S. Cl. ..... 430/110; 430/111; 430/137; 430/138; 430/109

[58] Field of Search ..... 430/109, 111, 430/137, 138, 110

[56] References Cited

U.S. PATENT DOCUMENTS

| | | | |
|---|---|---|---|
| 5,364,721 | 11/1994 | Asada et al. | 430/109 |
| 5,556,583 | 9/1996 | Tashiro et al. | 264/4.1 |
| 5,712,071 | 1/1998 | Mikuriya et al. | 430/111 |

FOREIGN PATENT DOCUMENTS

| | | |
|---|---|---|
| 0 505 648 A1 | 9/1992 | European Pat. Off. . |
| 5-66600 | 3/1993 | Japan . |

*Primary Examiner*—Roland Martin
*Attorney, Agent, or Firm*—Armstrong, Westerman, Hattori, McLeland & Naughton

[57] ABSTRACT

Disclosed are an electrophotographic toner which is a spherical particle comprising a binder resin having encapsulated therein a colorant and has a volume average particle size of from 3 to 12 $\mu$m, the binder resin being a non-crosslinked styrene-acrylic resin having an acid value of from 30 to 120, containing from 5 to 60% by weight of the components having a molecular weight in terms of polystyrene by gel permeation chromatography of 200,000 or more and having a ratio (Mw/Mn) of the weight-average molecular weight Mw to the number-average molecular weight Mn of from 4 to 30; and a process for preparing an electrophotographic toner comprising spherical particles having a volume average grain size of from 3 to 12 $\mu$m, the process comprising mixing a mixture comprising the above-described resin, a colorant, a wax and an organic solvent as essential components with an aqueous medium in the presence of a neutralizer in an amount sufficiently large to render the resin self-emulsifiable to effect phase inversion emulsification, thereby producing particles each comprising a binder resin having encapsulated therein a colorant and a wax in the liquid medium, and separating and drying the particles. The toner obtained by the present invention is improved in the thermal fixing characteristics and the environmental stability of charging, exhibits a wide fixing temperature width at the heated roll fixing and has excellent triboelectricity.

14 Claims, No Drawings

ELECTROPHOTOGRAPHIC TONER AND PROCESS FOR THE PREPARATION THEREOF

This application is a continuation-in-part of application Ser. No. 08/808,843, filed Feb. 28, 1997, now abandoned.

FIELD OF THE INVENTION

The present invention relates to a powder toner for use in the development of an electrostatic latent image in a copying machine or printer by the electrophotographic process. More specifically, the present invention relates to a toner suitable for the process comprising fixing over a heated roll and to a process for the preparation of the toner.

BACKGROUND OF THE INVENTION

Various toners are being used as the electrophotographic toner, however, almost all are amorphous toners prepared by the so-called grinding method and a very small number of toners are spherical toners prepared by the polymerization method.

In recent years, the toner is required to satisfy various demands so as to improve the image quality or save energy of a copying machine or printer. For example, the toner is keenly required to have a small particle size for improving the image quality, however, the amorphous toner prepared by the grinding method cannot be free of conspicuous reduction in the fluidity as a result of formation into small particles. Further, the colorant comes out on the surface of a toner particle and accordingly, the control of electrostatic charge is troublesome. Furthermore, in order to reduce the demand power of a copying machine or printer, the toner must have both the capability of fixing at low temperatures and the hot-offset resistance.

Almost all toners (in particular, a negatively polar toner comprising a styrene-acrylic resin as the binder) use a CCA (charge control agent), however, the CCA contains a heavy metal and may pollute the environment and therefore, it is desired, if possible, not to use the CCA.

The electrophotographic toners known up to the present time in the field of conventional techniques such as the grinding method or polymerization method have not succeeded in satisfying all these requirements.

The process for preparing a toner by the phase inversion emulsification method is a new technique of which basic technique is first disclosed in JP-A-5-66600 (the term "JP-A" as used herein means an "unexamined published Japanese patent application"). JP-A-5-66600 describes a negatively charging toner comprising an anionic self-emulsifiable binder resin having encapsulated therein a colorant and the preparation process thereof, in which the particle size distribution and the triboelectricity are mainly studied but the fixing property is not specifically compared and studied. The binder resin used here is a styrene-acrylic resin having a weight-average molecular weight of from 35,000 to 60,000 and in the light of the technical structure of the present invention, the styrene-acrylic resin obtained according to JP-A-5-66600 comprises less than 4% of the components having a molecular weight in terms of polystyrene by GPC of 200,000 or more and has a Mw/Mn ratio of about 3.

To speak roughly, the preparation process of the toner by the phase inversion emulsification method is a technique of dispersing an organic solvent solution of a resin containing a hydrophilic group and having a self-emulsifiability, a colorant and the like in an aqueous medium and forming a spherical particle having encapsulated therein a colorant.

This process is advantageous in that the particles can be easily prepared without consuming huge energy such as grinding and at the same time, small size particles can be very easily prepared. Further, particles having a sharp grain size distribution can also be prepared. Furthermore, since a surface active agent or protective colloid is not substantially used, the cleaning operation can be simple and the problem of environmental stability of the charging is relatively lightened, as compared with the process using a dispersion stabilizer such as a polymerization toner.

However, in the preparation process of the toner by the conventional phase inversion emulsification method, an organic solvent solution of resin is used and a cross-linked resin cannot be used substantially. Further, even if the resin used is not crosslinked, when the resin used contains less than 4% of the components having a molecular weight in terms of polystyrene by GPC of 200,000 or more and has a Mw/Mn ratio of about 3 as described above, it is difficult to achieve satisfactory fixing properties.

Furthermore, the toner prepared by the phase inversion emulsification method using no surface active agent nor protective colloid is disadvantageous in that since the toner particle contains a polar group having hygroscopicity, the environmental stability (the degree of deflection in the triboelectricity of toner upon changing of the temperature or humidity) is insufficient and also it is considered to be ascribable to the spherical shape of the toner particle, the charge rising at the triboelectric charging is deficient.

The object to be attained by the present invention is to remarkably improve the heated roll fixing property by specifying the molecular weight distribution of the binder resin in the light of the construction of the binder resin used in JP-A-5-66600.

The ultimate object to be attained by the present invention in an optimized embodiment is to provide a toner which (1) is excellent in the heated roll fixing property, (2) has good fluidity even when the particle is formed to have a small size and (3) exhibits good triboelectricity even without using a CCA, more specifically, to provide a spherical toner capable of fixing with a heated roll over a wide fixing temperature range and having excellent triboelectricity while improving the thermal fixing property and the environmental stability of charging which are the problems most earnestly desired to solve in the conventional phase inversion emulsification method.

SUMMARY OF THE INVENTION

As a result of extensive investigations to obtain a toner having more excellent capabilities with respect to the above-described characteristic items required for the toner, the present inventors have found that when the toner is prepared such that the shape or form of the toner particle, the composition of the binder resin and the conditions of the external addition processing fall within a specific range, an electrophotographic toner having a wide temperature width for the heated roll fixing and excellent in the triboelectricity and fluidity can be prepared. The present invention has been accomplished based on this finding.

The present invention provides the following inventions:

1. an electrophotographic toner which is a spherical particle comprising a binder resin having encapsulated therein a colorant and has a volume-average particle size of from 3 to 12 $\mu$m, the binder resin being a non-crosslinked styrene-acrylic resin having an acid value of from 30 to 120, the resin containing from 5 to 60% by weight of the components having a molecular weight in terms of polystyrene by gel permeation chromatography of 200,000 or more and the resin having a ratio (Mw/Mn) of the weight-average molecular weight Mw to the number-average molecular weight Mn of from 4 to 30 (hereinafter referred to as the first invention);

2. a process for preparing an electrophotographic toner comprising spherical particles having a volume average grain size of from 3 to 12 μm, the process comprising mixing a mixture comprising a colorant, a resin which can be rendered self-emulsifiable upon neutralization and an organic solvent as essential components with an aqueous medium in the presence of a neutralizer in an amount sufficiently large to render the resin self-emulsifiable to effect phase inversion emulsification, thereby producing particles each comprising a binder resin having encapsulated therein a colorant in the liquid medium, and separating and drying the particles, wherein the resin which can be rendered self-emulsifiable upon neutralization is a non-crosslinked styrene-acrylic resin having an acid value of from 30 to 120, the resin contains from 5 to 60% by weight of the components having a molecular weight in terms of polystyrene by gel permeation chromatography of 200,000 or more and the resin has a ratio (Mw/Mn) of the weight-average molecular weight Mw to the number-average molecular weight Mn of from 4 to 30 (hereinafter referred to as the second invention);

3. an electrophotographic toner obtained by externally adding, as the essential component, a metal oxide fine particle subjected to surface treatment with an organic compound containing a trifluoromethyl group or externally adding both an electrically conductive fine particle and a hydrophobic silica fine particle, to the spherical toner particle of the first invention (hereinafter referred to as the third invention); and 4. a process for preparing an electrophotographic toner, the process comprising externally adding, as the essential component, a metal oxide fine particle subjected to surface treatment with an organic compound containing a trifluoromethyl group or externally adding both an electrically conductive fine particle and a hydrophobic silica fine particle, to the spherical toner particle obtained by the second invention (hereinafter referred to as the fourth invention).

DETAILED DESCRIPTION OF THE INVENTION

The present invention is described in detail below.

The first invention is an electrophotographic toner having a volume average particle size of from 3 to 12 μm, wherein the toner particle has a spherical shape, a colorant is encapsulated in a binder resin and the binder resin is a non-crosslinked styrene-acrylic resin having an acid value and a molecular weight·molecular weight distribution each falling within a specific range. Due to the spherical shape, even when the toner is formed to have a small size, good fluidity can be attained and in the case where a colorant and a wax are encapsulated, the triboelectricity can be almost constant irrespective of the kind or content of the colorant or wax. Further, since the binder resin has a high acid value (numeral in mg of KOH necessary for neutralizing 1 g of resin) of from 30 to 120, good triboelectricity can be attained even without using a CCA fearful of environmental pollution. In addition to these effects, since the molecular weight and the molecular weight distribution of the binder resin each is limited to a specific range and a wax is incorporated, markedly good properties of heated roll fixing can be obtained.

When a wax is used in combination, the fixing initiation temperature can be more reduced and the fixing temperature width can be more expanded.

The second invention uses a styrene-acrylic resin having an acid value and a molecular weight·molecular weight distribution each falling within a specific range as the binder resin and can form a spherical toner particle free of voids within the particle and having a high aerated bulk density by the phase inversion emulsification method. By this invention, a toner having excellent properties with respect to the fixing property, triboelectricity, fluidity, mechanical strength and the like, can be prepared.

The most characteristic feature of the third and fourth inventions is to use a metal oxide fine particle surface-treated with an organic compound containing a trifluoromethyl group or to use an electrically conductive fine particle and a hydrophobic silica fine particle, as the external additive to the spherical toner. By this external addition, the toner of the present invention can be outstandingly improved in the environmental stability and the charge rising property.

The second invention in a preferred embodiment is performed by the following process:

a process for preparing an electrophotographic toner, comprising mixing a mixture comprising a resin which can be rendered self-emulsifiable upon neutralization, a colorant and an organic solvent as essential components with an aqueous medium in the presence of a neutralizer in an amount sufficiently large to render the resin self-emulsifiable to effect phase inversion emulsification, thereby producing particles each comprising a self-emulsifiable resin having encapsulated therein a colorant, and separating and drying the particles to prepare spherical toner particles, wherein the resin which can be rendered self-emulsifiable upon neutralization is obtained from two or more mixtures of addition-polymerizable monomers, of which product resins are different in the glass transition temperature, by polymerizing one mixture out of the plurality of mixtures and subsequently polymerizing another mixture in the same reaction vessel (hereinafter referred to as the fifth invention);

a process for preparing an electrophotographic toner, comprising mixing a mixture comprising a resin which can be rendered self-emulsifiable upon neutralization, a colorant and an organic solvent as essential components with an aqueous medium in the presence of a neutralizer in an amount sufficiently large to render the resin self-emulsifiable to effect phase inversion emulsification, thereby producing particles each comprising a self-water-dispersible resin having encapsulated therein a colorant, and separating and drying the particles to prepare spherical toner particles, wherein the resin which can be rendered self-emulsifiable upon neutralization is obtained from two or more mixtures of addition-polymerizable monomers, of which product resins are different in the glass transition temperature and also different in the weight-average molecular weight, by polymerizing one mixture out of the plurality of mixtures and subsequently polymerizing another mixture in the same reaction vessel (hereinafter referred to as the sixth invention);

a process for preparing an electrophotographic toner, comprising mixing a mixture comprising a resin which can be rendered self-emulsifiable upon neutralization, a colorant, a wax and an organic solvent as essential components with an aqueous medium in the presence of a neutralizer in an amount sufficiently large to render the resin self-emulsifiable to effect phase inversion emulsification, thereby producing particles each comprising a self-emulsifiable resin having encapsulated therein a colorant and a wax, and separating and drying the particles to prepare spherical toner particles, wherein the resin which can be rendered self-emulsifiable upon neutralization is obtained from two or more mixtures of addition-polymerizable monomers, of which product resins are different in the glass transition temperature, by polymerizing one mixture out of the plurality of mixtures and subsequently polymerizing another mixture in the same reaction vessel (hereinafter referred to as the seventh invention).

As in the invention described in JP-A-5-66600, the preparation process of the present invention is characterized by the use of a specific resin called self-emulsifiable resin. In the preparation process of the present invention, the self-emulsifiable resin undergoes a physicochemical phenomenon called phase inversion emulsification by which the hydrophilicity and hydrophobicity of the resin are balanced to produce spherical particles in a liquid medium. In some detail, an organic continuous phase containing an organic solvent and water alone or an aqueous medium comprising water (W phase) are mixed to cause the conversion of the form of the resin from W/O to O/W (so-called phase inversion emulsification) without using any emulsifier or dispersion stabilizer, whereby the phase of the resin is rendered discontinuous, producing a desired spherical particulate material.

According to the preparation process of toner particles by the phase inversion emulsification, a toner particle having an extremely high sphericity can be obtained. With respect to the sphericity, for example, toner particles substantially as a true sphere having an average roundness [an average of the roundnesses defined by (circumferential length of a circle having the same area as the projected area of a particle)/(circumferential length of the projected image of a particle)] of 0.97 or more can be obtained. The average roundness can also be obtained by taking an SEM (scanning-type electron microscope) photograph of a toner particle and measuring and calculating the values. However, the average roundness can be easily obtained using a flow-system particle image analyzer FPIP-1000 manufactured by Toa Iyo Denshi KK and in the present invention, the roundness is measured by this apparatus. In terms of the Wadell's sphericity, toner particles substantially as a true sphere having a sphericity of 0.8 or more, particularly 0.95 or more can be obtained.

The most characteristic feature of the fifth invention is the blending method of self-emulsifiable resins different, for example, in the composition, the molecular weight or the like. In other words, the second invention has a broader sense including mere blending of resins separately prepared, however, the fifth invention is different therefrom in that an eventually blended resin comprising a polymer obtained by previously polymerizing one mixture of addition-polymerizable monomers and then polymerizing another mixture of addition-polymerizable mixture in the same reaction vessel (in situ) is used.

In the case of using a "resin obtained by the mere blending" of two or more self-emulsifiable resins different in the glass transition temperature, different in the acid value or different in the molecular weight, there readily arise a problem that the particle forming property at the phase inversion emulsification is deteriorated and the toner obtained cannot have satisfactory properties with respect to the triboelectricity, fluidity and mechanical strength.

On the other hand, when in one reaction vessel, at least a small amount of polymer is produced at the first stage reaction and then the second stage mixture of addition-polymerizable monomers is added to the reaction system to polymerize all unreacted monomers as in the present invention, even if the monomer compositions used at the first and second stages differ from each other or the polymers produced at the first and second stages differ from each other in the molecular weight, since the resin component produced at the first stage has an effect of compatibilizing all the components contained in the reaction vessel, the resin in the reaction vessel after completion of the second-stage polymerization is greatly improved in the particle forming property at the phase inversion emulsification as compared with the above-described "merely blended resin" and in turn, the toner particle obtained is greatly improved in the triboelectricity, fluidity and mechanical strength.

The preparation process of the fifth invention is described in detail below. The preparation process of the present invention fundamentally comprises the following steps:

First Step:

A non-crosslinked styrene-acrylic resin containing from 5 to 60% by weight, preferably from 10 to 60% by weight, of the components having a molecular weight in terms of polystyrene by gel permeation chromatography (GPC) of 200,000 or more, and having a ratio (Mw/Mn) of the weight-average molecular weight Mw to the number-average molecular weight Mn of from 4 to 30, preferably from 5 to 20, and an acid value of from 30 to 120, is prepared.

In the present invention, the term "acryl", includes both methacryl and acryl in a narrow sense. These may be sometimes indicated collectively as "(meth)acryl".

In order to obtain a resin having such properties, the following methods can be employed.

1) A resin having some molecular weight which can be rendered self-emulsifiable is obtained. Separately, one or more resins which are compatible with the foregoing resin but have weight-average molecular weights different from that of the foregoing resin are obtained. These two or more resins are then blended. In other words, the foregoing two or more resins having different weight-average molecular weights are separately synthesized, and then blended in a predetermined ratio (simply-blended resin).
2) A mixture of addition-polymerizable monomers is polymerized in a reaction vessel. Another mixture of addition-polymerizable monomers is then polymerized in the same reaction vessel (in-situ) to produce a polymer (resin). Eventually, two or more resins having different weight-average molecular weights as in the foregoing process (1) are blended (in-situ resin).

In some detail, as the resin which can be rendered self-emulsifiable upon neutralization there is preferably used a styrene-acrylic resin having an acid value of from 30 to 120 obtained by polymerizing one of two or more different mixtures of addition-polymerizable monomers, at least one of said mixtures comprising styrene and/or (meth)acrylic acid ester and the whole of said mixtures comprising styrene and (meth)acrylic acid ester, in a reaction vessel until the conversion reaches a range of from 20% to 80%, and then adding the other to the polymerization system in the same reaction vessel to cause further polymerization.

Whichever process 1) or 2) above may be used, the difference in the solubility parameter between respective resins is preferably restrained to be within 0.5 so as to obtain a self-emulsifiable resin having excellent compatibility. In the case when the unneutralized resin is anionic, a resin having an acid value of from 30 to 120 is generally combined in either process.

The fact that these resins are dissolved in each other can be confirmed, e.g., by differential scanning calorimetry (DSC). In some detail, it can be made by checking if the glass transition point appears only at one peak.

In the step following the first step, two or more resins which can be rendered self-emulsifiable upon neutralization synthesized above, a neutralizer (base) in an amount sufficiently large to render the resins self-emulsifiable, a colorant, an organic solvent and, if desired, a wax are mixed to obtain a mixture having uniformly dispersed therein the colorant and wax.

Two or more kinds of resins which can be rendered self-emulsifiable upon neutralization to form compatible resins having different properties and weight-average molecular weights (Mw), a neutralizer (base or acid) and an organic solvent (D) are subjected to blending and dispersion (dispersion of colorant) to obtain a blend.

Anyway, two or more kinds of resins which can be rendered self-emulsifiable upon neutralization to form compatible resins having different properties and weight-average molecular weights (Mw), a neutralizer (base) in an amount sufficiently large to render the resins self-emulsifiable, a colorant and an organic solvent are subjected to blending and dispersion (dispersion of colorant) to obtain a blend.

In general, two or more kinds of resins which can be rendered self-emulsifiable upon neutralization to form compatible resins having different properties and a neutralizer (base) are used to prepare self-emulsifiable resins.

Second Step:

The mixture obtained in the first step is mixed with an aqueous medium (water alone or a liquid medium essentially consisting of water) to effect phase inversion emulsification, thereby producing toner particles. In this case, the phase inversion emulsification may be effected either by adding an aqueous medium to the above-described mixture or by adding the mixture to an aqueous medium.

In some detail, the phase inversion emulsification in the presence of a neutralizer can be effected in the following two main manners.

(1) As the blend to be subjected to phase inversion emulsification there is used a blend of self-emulsifiable resins obtained by neutralizing with a neutralizer resins which can be rendered self-emulsifiable upon neutralization. The blend thus prepared is subjected to phase inversion emulsification in an aqueous medium.

(2) As the blend to be subjected to phase inversion emulsification there is used a blend of resins which can be rendered self-emulsifiable upon neutralization. The blend thus prepared is subjected to phase inversion emulsification in an aqueous medium containing a neutralizer in an amount sufficiently large to render the blend self-emulsifiable.

Needless to say, the neutralizer in an amount sufficiently large to render the resins which can be rendered self-emulsifiable upon neutralization may be present in the blend alone or in the aqueous medium alone. However, it may be divided into two parts which are then present in both the blend and aqueous medium, respectively.

The temperature at which phase inversion emulsification is effected is not specifically limited. It is desirable that the system temperature should be arranged to range from 5° C. to 40° C. If possible, the foregoing blend and aqueous medium are preferably prepared in an arrangement such that the difference in temperature between them is minimized in this temperature range.

In this second step, a toner particle comprising a self-emulsifiable resin having encapsulated therein a colorant and if desired, a wax, is produced in the liquid medium.

Third Step:

From the liquid medium having dispersed therein toner particles formed by the phase inversion emulsification, only the particles are separated and dried.

In the separation of the particles from the liquid medium, it is preferred to previously remove the organic solvent from the liquid medium and then separate the particles. The organic solvent can be removed, for example, by the distillation under reduced pressure after the formation of toner particles.

In the case where the self-emulsifiable resin in the toner particle is obtained by neutralizing a resin which can be rendered self-emulsifiable upon neutralization, with a neutralizer, the particles are preferably separated and dried after returning the acid radical to its original acid of the unneutralized state by mixing the aqueous dispersion solution of toner particles from which only the organic solvent is removed, with a neutralizer having a polarity opposite to that of the above-described neutralizer or an aqueous solution thereof.

Due to the treatment with a neutralizer (acid) having an opposite polarity, the toner particles can be easily separated from the aqueous medium and the process can more smoothly proceed into the subsequent step. By this treatment, the resin in the particle enters the unneutralized state.

For example, when the resin in the toner particle is an anionic self-emulsifiable resin, the pH is adjusted to from 2 to 3 with an acid aqueous solution and under stirring, the self-emulsifiable resin is converted into a resin which can be rendered self-emulsifiable upon neutralization. By converting the resin constituting the toner particle, the toner can be more improved in the environmental resistance such as humidity change.

The acid aqueous solution may use any known conventional and commonly used acid which does not deteriorate the above-described resin. Examples thereof include hydrochloric acid, sulfuric acid, oxalic acid and acetic acid. An aqueous hydrochloric acid solution of from 0.1 to 1N is usually used.

The toner of the present invention has an acid value of from 30 to 120 and this is a value when the binder resin contains only a free acid radical (namely, in the state of unneutralized acid). Accordingly, when the binder resin in the toner contains at least a neutralized acid radical, the measurement of the acid value may be performed after converting all the neutralized acid radicals into free acid radicals by the above-described operation.

The toner particle separated from the aqueous medium is dried to obtain toner powder. The drying may be performed by any conventional and commonly used means. For example, the toner particle may be hot-air dried at a temperature such that the toner particles are not heat-fused or agglomerate or may be freeze-dried. Further, a method of performing the separation of the toner particle from the aqueous medium and the drying thereof simultaneously using a spray dryer or the like, may also be used.

The present invention will be further described hereinafter.

As the self-emulsifiable resin employable herein there may be used a resin having an anionic hydrophilic group in its molecular chain which has been neutralized with a base to further enhance the hydrophilicity of the hydrophilic group.

The hydrophilicity thus attained must be such that the resin itself can be dispersed in water. When mixed with an aqueous medium, such a self-emulsifiable resin can undergo phase inversion emulsification to form a particulate material even if no surface active agent or dispersion stabilizer is used.

Examples of the neutralizer for neutralizing the acid radical in the resin which can be rendered self-emulsifiable upon neutralization (resin containing an acid radical) to produce a self-emulsifiable resin, if the resin is an acid radical-containing resin which can be rendered self-emulsifiable upon neutralization, include tertiary amine such as triethylamine, inorganic base such as sodium hydroxide and potassium hydroxide, and ammonia. These neutralizers may be properly used to neutralize the resin.

The hydrophilicity of the acid radical-containing resin which can be rendered self-emulsifiable upon neutralization can be controlled by the content of the functional groups which can add to its hydrophilicity upon neutralization or by the amount neutralized (percent neutralization). Further, the hydrophilicity determines the size of the toner particles during dispersion at the 2nd step. In other words, the percent neutralization can be controlled to make it easy to obtain toner particles having an arbitrary particle size.

The amount of the neutralized acid radical required to allow the resin to become self-emulsifiable (amount neutralized or percent neutralization) differs from one resin to another because the hydrophilicity of resins themselves vary due to their composition, molecular weight, structure, etc. In general, it ranges from 10 to 50 mg equivalent per 100 g of solid content of self-emulsifiable resin.

If the resin which has been rendered self-emulsifiable upon neutralization at the 3rd step described later needs to be partly or entirely converted to a resin which can be rendered self-emulsifiable upon neutralization (e.g., resin containing an acid radical), a part or whole of hydrophilic groups contained in the self-emulsifiable resin may be neutralized with a neutralizer (e.g., acid) having the same polarity as that of latent functional groups which can add to its hydrophilicity upon neutralization.

The resin containing an unneutralized anionic hydrophilic group in its molecular chain will be hereinafter referred to as "resin which can be rendered self-emulsifiable upon neutralization". The resin which can be dispersed in water whether or not it is neutralized will be hereinafter referred to as "self-emulsifiable resin". As mentioned above, the neutralization of the resin which can be rendered self-emulsifiable upon neutralization may be effected shortly before the blending with an aqueous medium at the 2nd step or at the same time with the blending with an aqueous medium during phase inversion.

As the resin which can be rendered self-emulsifiable upon neutralization or self-emulsifiable resin employable herein there may be used a copolymer of addition-polymerizable monomers such as styrene-(meth)acrylic acid ester copolymer resin. Styrene-(meth)acrylic acid ester resins (hereinafter referred to as "styrene-acrylic resin"), which can easily provide a toner having well-balanced powder fluidity, fixability and other properties, are desirable.

The present invention will be further described hereinafter with reference to the styrene-acrylic resin by way of example.

In the present invention, the styrene-acrylic resin which can be rendered self-emulsifiable upon neutralization is a styrene-acrylic resin which can make the use of the effect of a functional group contained in its molecule capable of adding to its hydrophilicity upon neutralization to form a stable aqueous dispersion under the action of an aqueous medium without substantially using any emulsifier or dispersion stabilizer.

The styrene-acrylic resin which can be rendered self-emulsifiable upon neutralization for use in the present invention can be obtained, for example, by radical-polymerizing a mixture of an acryl-base polymerizable monomer having an acid radical and other than this polymerizable monomer having a hydrophilic group, a polymerizable monomer containing styrene and (meth)acrylic ester, further if desired, after adding thereto a (meth)acrylic acid derivative and other vinyl group-containing monomer, in the presence of a radical initiator.

In the present invention, two or more separately synthesized resins which can be rendered self-emulsifiable upon neutralization may be used in admixture as mentioned above. Preferably, two or more addition-polymerizable monomers are used to prepare a mixture of two or more resins having different glass transition temperatures (Tg). As Tg there may be employed calculated value based on Fox's equation. The calculated Tg is Tg of a resin produced when it is assumed that the conversion of the addition-polymerizable monomer reaches 100%. If two mixtures are subjected to polymerization, they are each prepared such that the kind and weight proportion of the monomers are selected to produce resins having different glass transition temperatures Tg and further preferably having different weight-average molecular weight Mw. Similarly, if three or more mixtures are subjected to polymerization, they are prepared different. In general, these mixtures are prepared from two or more addition-polymerizable monomers.

These mixtures of addition-polymerizable monomers preferably have an acid value of from 30 to 120.

The weight ratio of the addition-polymerizable monomer to be first polymerized to the addition-polymerizable monomer to be subsequently polymerized is not specifically limited. If two mixtures are subjected to polymerization, it may be from 30/70 to 70/30. This applies to the foregoing process 2) in which an in-situ resin is obtained as well as to the foregoing process 1) in which separately synthesized resins are blended to obtain a merely blended resin.

Examples of the foregoing acrylic polymerizable monomer containing an acid radical include acrylic acid, methacrylic acid, crotonic acid, itaconic acid, maleic acid, fumaric acid, monobutyl itaconate, monobutyl maleate.

Examples of the polymerizable monomer other than the polymerizable monomer containing an acid radical include styrenic monomer (aromatic vinyl monomer) such as styrene, vinyltoluene, 2-methylstyrene, t-butylstyrene and chlorostyrene.

In the present invention, acrylic acid ester and methacrylic acid ester are collectively referred to as "(meth)acrylic acid ester".

Examples of (meth)acrylic acid ester include methyl (meth)acrylate, ethyl (meth)acrylate, propyl methacrylate, isopropyl acrylate, n-butyl (meth)acrylate, isobutyl (meth) acrylate, n-amyl (meth)acrylate, isoamyl acrylate, n-hexyl (meth)acrylate, 2-ethylhexyl acrylate, n-octyl (meth) acrylate, decyl (meth)acrylate, dodecyl (meth)acrylate, 2-chloroethyl (meth)acrylate, phenyl (meth)acrylate, and methyl alpha-chloro(meth)acrylate.

Other examples of (meth)acrylic acid ester include acrylic or methacrylic acid derivative such as acrylonitrile, meth-acrylonitrile and acrylamide, vinyl ether such as vinyl methyl ether, vinyl ethyl ether and vinyl isobutyl ether, vinyl ketone such as vinyl methyl ketone, vinyl hexyl ketone and methyl isopropenyl ketone, and N-vinyl compound such as N-vinylpyrrole, N-vinylcarbazole, N-vinylindole and N-vinylpyrrolidone.

As the polymerization initiator employable herein there may be used any known conventional organic peroxide initiator or azo initiator. Specific examples of these initiators include peroxide such as benzoyl peroxide, cumene hydroperoxide, t-butyl hydroperoxide, sodium persulfate and ammonium persulfate, and azo compound such as azobisisobutyronitrile and azobisisovaleronitrile.

On the other hand, the self-emulsifiable styrene-acrylic resin is an acid radical-containing acrylic resin having a functional group which adds to its hydrophilicity upon neutralization of the hydrophilic group, said functional group having been neutralized with a neutralizer. The salt structure takes part in the stable dispersion of the resin in an aqueous medium. As mentioned above, the salt structure can exert the same effect whether it is obtained by neutralizing with a neutralizer the functional group which can be rendered self-emulsifiable upon neutralization or it has been previously present in the resin.

The self-emulsifiable resin to be used in the present invention can be dispersed as such in water but may be optionally dispersed in water in combination with a known conventional surface active agent (emulsifier) or dispersion stabilizer. However, the amount of these additives to be used is preferably minimized.

For the foregoing reaction, known conventional additives such as chain transfer agent, reducing agent and chelating agent may be used as well.

The synthesis of the resin can be accomplished by any known conventional method but is preferably accomplished by a solution polymerization process. In the present invention, as the resin which can be rendered self-emulsifiable upon neutralization there is preferably used one obtained by polymerizing one of two or more mixtures of addition-polymerizable monomers which produce resins having different glass transition temperatures (calculated value) and preferably further having different weight-average molecular weight in a reaction vessel, and then polymerizing the other mixture in the same reaction vessel in the presence of the product of the foregoing polymerization reaction.

If the foregoing process is effected such that a blend of two different self-emulsifiable resins is eventually obtained, the addition-polymerizable monomer in the mixture to be first polymerized is reacted in a reaction vessel until the conversion reaches 20 to 80%, followed by the polymerization of the addition-polymerizable monomer in the subsequent reaction mixture in the same reaction vessel.

If the foregoing process is effected such that a blend of three different self-emulsifiable resins is eventually obtained, the addition-polymerizable monomer in the mixture to be first polymerized is reacted in a reaction vessel until the conversion reaches 20% to 80%. Subsequently, the second mixture is added to the reaction product in the same reaction vessel where the addition-polymerizable monomers are then reacted until the conversion reaches 20% to 80%. The third mixture is then added to the reaction product in the same reaction vessel for further polymerization reaction.

In order to maximize the effect of compatibilizing all the components contained in the reaction vessel, it is effective to arrange the conversion of the monomer at a stage to the above defined range before the addition of the mixture subjected to the subsequent stage polymerization.

The conversion of the monomer in the reaction vessel in this procedure can be judged, e.g., by determining the content of residual addition-polymerizable monomers by gas chromatography.

Since the polymerization reaction of the first addition-polymerizable monomer is terminated in the course of polymerization, followed by the reaction of the subsequent addition-polymerizable monomers, the difference between the two components can be eliminated.

As the organic solvent to be used in the preparation of the foregoing resin there may be any organic solvent. Examples of such an organic solvent include hydrocarbons such as toluene, xylene, benzene, n-hexane, cyclohexane and n-heptane, alcohols such as methanol, ethanol, isopropanol, n-propanol, n-butanol, isobutanol, sec-butanol and t-butanol, ether alcohols such as propylene glycol monomethyl ether, propylene glycol monoethyl ether, propylene glycol monoisopropyl ether, propylene glycol mono-n-butyl ether, ethylene glycol monomethyl ether, ethylene glycol monoethyl ether, ethylene glycol monoisopropyl ether and ethylene glycol mono-n-butyl ether, ketones such as acetone, methyl ethyl ketone and methyl isobutyl ketone, esters such as ethyl acetate, butyl acetate and isobutyl acetate, ether esters such as propylene glycol monoethyl ether acetate and ethylene glycol monoethyl ether acetate, cyclic ethers such as tetrahydrofuran, and halogenated hydrocarbons such as methylene chloride.

In the preparation process of the present invention, the content of the polymerizable monomer containing a hydrophilic group such as acid radical is preferably made uniform all over the resin chains to form a good toner particle.

To this end, a known conventional method can be employed. For example, among many organic solvents, an organic polar solvent having a solubility parameter (SP) of not less than 9 is preferably used. Examples of the organic polar solvent having SP of not less than 9 include methyl ethyl ketone, ethyl acetate, acetone, butyl cellosolve, isopropyl alcohol, and butanol. Preferred among these organic polar solvents are methyl ethyl ketone, ethyl acetate, and acetone, due to easiness of desolvent. Methyl ethyl ketone is particularly preferred. Even more desirable is a water-containing solvent obtained by adding water to the foregoing organic polar solvent in an amount of from 0.5 to 30% by weight, preferably from 2 to 20% by weight.

If the water content of the organic polar solvent falls below 0.5% by weight, the uniformity of the content of an acid radical all over the resin skeletons is less sufficient. On the contrary, if the water content of the organic polar solvent exceeds 30% by weight, the resin separates out in the reaction system, possibly rendering the reaction system nonuniform.

Referring to the kind of solvent, if a hydrophobic organic solvent such as toluene and xylene is used for the polymerization reaction, e.g., of an acid radical-containing polymerizable monomer, the resulting polymerization rate is so high that the content of acid radical is nonuniform all over the resin chain molecules, giving some adverse effects on the formation of toner particles during phase inversion emulsification.

On the other hand, in the hydrous solvent system comprising a predetermined amount of water incorporated in a polar solvent, the acid radical-containing polymerizable monomer is possibly dissolved in the water and reacts with the other polymerizable monomers at various reaction sites, lowering the reaction rate. Thus, the polymerization rate of the various addition-polymerizable monomers can be substantially uniform, making it easy to form a good toner particle during phase inversion emulsification to advantage.

In a preferred example of the foregoing in-situ polymerization process of the present invention, the water content of both the organic solvent to be used during the production of a high molecular weight polymer at the 1st stage and the organic solvent to be used during the production of a middle molecular polymer or low molecular polymer at the 2nd and subsequent stages may be predetermined to a range of from 0.5 to 30% by weight. Alternatively, the water content of organic solvent may differ from the 1st stage to the 2nd stage.

However, if the water content of the organic solvent to be used during the production of a high molecular weight polymer at the 1st stage is predetermined high within the above defined range, the arrangement of acid radical-containing polymerizable monomers in the eventually obtained resin can be sufficiently uniform regardless of the water content of the organic solvents to be used at the 2nd and subsequent stages, making it possible to use a water-free organic solvent alone to produce a middle molecular or low molecular polymer at the 2nd and subsequent stages. Needless to say, the total water content of the organic solvents to be used at the 1st and 2nd stages may be predetermined to a range of from 0.5 to 30% by weight regardless of the water content of the organic solvent to be used at the 2nd stage.

If the solution polymerization process is employed to obtain a resin which can be rendered self-emulsifiable upon neutralization, the resulting resin solution may be freed of the liquid medium to leave only a solid resin content which is then dissolved in another organic solvent capable of dissolving it therein to prepare a mixture for phase inversion emulsification. Alternatively, the foregoing resin solution can be used as it is to prepare a mixture for phase inversion emulsification comprising a colorant incorporated therein.

In the case where the solution polymerization process is employed, if the organic solvent to be used during polymerization is different from that to be used for the preparation of the mixture to be subjected to phase inversion emulsification, the mixture is arranged to contain as less unreacted monomers as possible. Alternatively, if the two organic solvents are not different from each other as mentioned above, the polymerization degree of the addition-polymerizable monomer in the reaction vessel at the final stage of polymerization is as close to 100% as possible so that the resulting resin contains as less unreacted monomers as possible.

The resin produced from the mixture (A) of addition-polymerizable monomers to be first polymerized may differ in weight-average molecular weight from the resin produced from the mixture (B) of addition-polymerizable monomers to be subsequently polymerized, said mixture (B) containing some unreacted addition-polymerizable monomers in the mixture (A).

The former resin may have a weight-average molecular weight of from 80,000 to 500,000 while the latter resin may have a weight-average molecular weight of from 6,000 to 60,000.

In this case (when the molecular weight distribution has two peaks), the resin component originating in the mixture (A) component and the resin component originating in the mixture (B) component are preferably present in an area ratio by gel permeation chromatography (GPC) of from 10/90 to 60/40.

The area ratio as used herein is a ratio of respective areas separated with the border formed at the bottom in the GPC chart determined.

As mentioned above, the first polymerization reaction is effected in a reaction vessel in the presence of no polymerization initiator or, if any, an extremely small amount of a polymerization initiator free from solvent or in such a manner that a high monomer concentration is reached to synthesize a high molecular weight polymer which is then diluted with an organic solvent. Subsequently, a second mixture is polymerized in the same reaction vessel in the presence of the high molecular weight polymer to synthesize a low molecular polymer. As a result, a blend of a high molecular weight polymer and a low molecular polymer can be obtained.

In the blending of single resins having the same glass transition temperature, the high molecular weight polymer which can form particles at the phase inversion emulsification is limited in the weight-average molecular weight up to 200,000 and at the same time, the particles formed are not satisfied in the particle distribution or the toner particle shape. On the other hand, in the preparation process of the present invention, a high molecular weight polymer having a molecular weight higher than the above-described polymer can be used.

This is because the resin produced intermediate between the resin produced from the first mixture (A) of addition-polymerizable monomers and the subsequent mixture (B) of addition-polymerizable monomers has many regions having a molecular weight of from 30,000 to 80,000 which particularly can easily form particles during phase inversion emulsification, apart from the final toner properties, said regions being difficult to occur sufficiently in the case where the mixtures (A) and (B) are separately synthesized. Thus, in accordance with the preparation process of the present invention, despite its higher content of a high molecular weight polymer than in the conventional methods, the resin can undergo good phase inversion emulsification to obtain a toner particle excellent in triboelectricity, fluidity and mechanical strength.

In the phase inversion emulsification method, the particles are formed in an aqueous medium using the balance between the hydrophilicity and the hydrophobicity of the resin and therefore, when resins different in the composition (difference in the glass transition temperature=difference in the hydrophilicity or hydrophobicity of the resin) or in the molecular weight are blended, the particle formation process is greatly affected. For example, in the case of forming particles from single resin, the particle forming ability at the phase inversion emulsification is liable to lower at the weight-average molecular weight of 20,000 or less or 100,000 or more.

By using a resin obtained by the above-described in-situ process employed in the present invention and facilitated in the incorporation of a necessary amount of resin components having a weight-average molecular weight or acid value most suitable for the formation of particles, a preparation process of toner particles excellent in both the particle forming ability and the toner final capability can be provided.

The optimum range of the weight-average molecular weight of the resin suitable for the formation of particles is from 40,000 to 80,000. The optimum range of the acid value of the resin is from 60 to 80. The acid value as used herein is represented by mg of KOH (potassium hydroxide) required to neutralize 1 g of the specimen to be measured. The acid value of the resin thus produced is almost the same as that of the resin in the unpolymerized mixture.

In the present invention, the acid value of the resin may range from 30 to 120 as a whole of the binder resin. For example, the low or middle molecular one of merely blended two resins having different molecular weights (Mw) or the resin obtained from the mixture to be polymerized at the 2nd and subsequent stages in the in-situ polymerization process may have no acid value or have an acid value of less than 30. However, the acid value of the high molecular one of merely blended two resins having different molecular weights (Mw) or the resin obtained from the mixture to be first polymerized in the in-situ polymerization process and the acid value of the low or middle molecular one of merely blended two resins having different molecular weights (Mw) or the resin obtained from the mixture to be polymerized at the 2nd and subsequent stages in the in-situ polymerization process are preferably the same as or close to each other.

The resin produced by the polymerization of the mixture (A) of addition-polymerizable monomers to be first polymerized and the resin produced by the polymerization of the mixture (B) of addition-polymerizable monomers to be subsequently polymerized may differ from each other to advantage. For example, the mixtures (A) and (B) are preferably prepared such that the resin produced from the former mixture (A) has a glass transition temperature of from 0° C. to 60° C. while the resin produced from the latter mixture (B) has a glass transition temperature of from 45° C. to 80° C., whereby the resin component in the reaction vessel after the final polymerization has a glass transition temperature (the found value measured by DSC) of from 50° C. to 70° C.

In the fifth invention of the present invention, the resin obtained from the mixture (A) and the resin obtained from the mixture (B) containing unreacted monomers in the mixture (A) may possibly occur in some combinations with respect to molecular weight and Tg.

For example, the mixtures used are respectively prepared such that the Tg of the product resin determined on the assumption that 100% of the addition-polymerizable monomers in the mixture first polymerized are reacted is lower than the Tg of the product resin determined on the assumption that 100% of the addition-polymerizable monomers in the mixture subsequently added to the same reaction vessel are reacted. The same goes for both the case of preparing an in-situ resin and the case of preparing a merely blended resin.

In some detail, the former resin and the latter resin may occur in such a combination that the molecular weight and Tg of the former resin are relatively higher than that of the latter resin. However, the former resin and the latter resin preferably occur in such a combination that the former resin has a relatively higher molecular weight and a relatively lower Tg than the latter resin to provide further improvement in low temperature fixability while maintaining the desired storage stability as compared with single resin system.

When the mixtures (A) and (B) are used in the foregoing preferred combination with respect to molecular weight and Tg in the preparation process of the present invention, the resin having a relatively low molecular weight obtained by introducing the mixture (B) into the reaction vessel has a higher hydrophilicity and fluidity than the resin obtained from the mixture (A) and thus tends to be positively localized on the surface of the toner particle. Accordingly, the resin concentration of the mixture (B) containing unreacted monomers of the mixture (A) in the resin comprising the mixtures (A) and (B) dissolved in each other is higher towards the surface of the toner particle. Then, a thin layer of hydrophilic group is formed as the outermost layer of the toner particle. This particle structure makes a great contribution to the realization of the effects of the present invention.

In the grinding method as a dry process for the preparation of a toner, even if a resin having the same monomer composition as in the preparation process of the present invention is used to prepare a toner, the resulting particles have a uniform inner composition that deteriorates the storage stability thereof and hence ill-balances the thermal properties thereof.

The above-described excellent effects of the fifth invention can be achieved because in the preparation process of the binder resin of the present invention, the toner particle forming ability at the phase inversion emulsification is superior. When the molecular weight of a binder resin is increased, in the case of a preparation process of toner by the conventional phase inversion emulsification method where the toner particle readily has voids, the toner is reduced in the aerated bulk density, the fluidity, the mechanical strength or the like and further, is difficult to have the required storage stability.

In the preparation process of toner from a single resin-base blend by the phase inversion emulsification method, the particle forming ability at the phase inversion emulsification is inferior and therefore, the high molecular weight polymer cannot be increased in the molecular weight and in the content thereof.

The resin contained and having a relatively low molecular weight is high in the hydrophilicity and fluidity and therefore, liable to aggressively localize on the particle surface, thus, the concentration of the resin in a compatibilized resin becomes higher in the portion closer to the surface. Then, a thin layer of the hydrophilic group is formed as an outermost layer of the toner particle and contributes to the storage stability, however, this effect is also small because the particle forming ability at the phase inversion emulsification is inferior.

As a result, even in the blending of resins different in the glass transition temperature, the glass transition temperature of the resin on one side cannot be reduced and a low-temperature fixing property of a satisfactory level cannot be obtained.

The presence or absence of a void can be evaluated by measuring the aerated bulk density and when the particle primary body has an aerated bulk density ($g/cm^3$)$\geqq$0.35, advantageous results are obtained with respect to the above-described characteristics.

On the other hand, according to the preparation process of the fifth invention, the following effects can be achieved because even though the resin components differ in the glass transition temperature (composition), differ in the molecular weight or contain a relatively large amount of polymers having a relatively high molecular weight than in the conventional process, the components are obtained by the in-situ method and have excellent capability of forming spherical toner particles at the phase inversion emulsification.

In the resin which can be rendered self-emulsifiable upon neutralization, the high molecular weight polymer component can be increased in the molecular weight and also in the content thereof, accordingly, the toner particle powder formed can be ensured with sufficiently high hot-offset resistance.

In the case when a low molecular weight polymer is contained, the toner particle formed can have excellent low-temperature fixing property and exhibit excellent storage stability due to occurrence of change in the composition within the toner particle.

As a result, even in the blending of resins different in the glass transition temperature, the glass transition temperature of resin on one side can be reduced and the toner particle powder obtained can have low-temperature fixing property of a satisfactory level.

By incorporating various monomer components for controlling triboelectricity in the mixture to be used in the formation of the resin having a relatively low molecular weight which can be rendered self-emulsifiable upon neutralization, the triboelectricity of the toner can be effectively controlled.

The resin used in the present invention which can be rendered self-emulsifiable upon neutralization is preferably non-crosslinked. In some detail, two or more mixtures of two or more addition-polymerizable monomers are preferably prepared such that none of them are substantially free of bifunctional or higher crosslinkable monomers. These mixtures are then preferably subjected to polymerization reaction at various stages in accordance with the foregoing procedure. At the same time, the polymerization reaction is preferably effected to cause phase inversion emulsification in the absence of crosslinking agent.

In the process for the preparation of the toner particles of the present invention, a known conventional colorant may be used. Specific examples of such a known conventional colorant include carbon black, magnetic powder, aniline blue, chalcoyl blue, chrome yellow, ultramarine blue, Du Pont oil red, quinoline yellow, methylene blue chloride, phthalocyanine blue, malachite green oxalate, lamp black, rose bengale, C.I. pigment red 122, C.I. pigment yellow 97, C.I. pigment blue 15, triiron tetraoxide, iron sesquioxide, and iron powder. These pigments may be used singly or in combination.

In the 1st step of the second, fifth, sixth and seventh inventions, a mixture (occasionally referred to as "mill base") to be subjected to phase inversion emulsification, comprising the foregoing resin which can be rendered self-emulsifiable upon neutralization, a colorant and an organic solvent as essential components, and optionally a wax and a neutralizer is normally prepared. The amount of the colorant to be incorporated in the mixture may normally range from 3 to 15 parts by weight based on 100 parts by weight of the foregoing solid content of binder resin.

The preparation process of the present invention makes it possible to raise the colorant concentration in the toner particle as compared with the toner obtained by the polymerization process. For example, a toner having a colorant content [colorant/(binder resin +colorant)] of not less than 8.0% by weight which would be extremely difficult to attain in the polymerization process can be easily prepared. The higher the colorant content with respect to the same particle size is, the less is the amount of toner required to obtain an image having the same density. The feature of the preparation process is more favorable for the preparation process of the present invention than for the polymerization when a toner particle having a smaller particle size is obtained.

The nonvolatile content in the foregoing mixture is normally adjusted to a range of from 20 to 80% by weight.

As the organic solvent to be used in the preparation of the foregoing mixture there may be used any of the foregoing organic solvents. If the resin has been prepared by the solution polymerization method, the same organic solvent as used in the solution polymerization method may be used. Specifically, methyl ethyl ketone is particularly preferred as the organic solvent. As mentioned above, the organic solvents to be used in the solution polymerization method and in the preparation of the mixture may be different from each other.

In the preparation of the mixture, a water-soluble or partially water-soluble organic solvent such as acetone, butanol and isopropyl alcohol may be partly incorporated in the system to facilitate the production of a toner particle in the 2nd step.

Examples of the other constituents (additive components) employable herein include various auxiliaries such as CCA (charge control agent) and release agent. These auxiliaries may be properly selected and used depending on the purpose and working conditions thereof.

In any preparation process of the present invention, a release agent represented by wax or an auxiliary agent such as a CCA may be incorporated, if desired.

In the present invention, a binder resin having a high acid value is used and therefore, triboelectricity satisfactory as the toner can be achieved even without using a CCA having a fear of environmental pollution by the heavy metal contained therein, however, if desired, a CCA (charge control agent) or commonly known various auxiliary agents appropriately selected may be used.

In the preparation process of the present invention, a mixture containing a colorant to be subjected to phase inversion emulsification is used. The mixture may consist of three formers or all of a colorant, a resin which can be rendered self-emulsifiable upon neutralization, an organic solvent and a neutralizer to be used depending on the preparation process. The three former components or all the constituents may comprise a finely particulate wax incorporated therein.

The addition of the wax will be further described hereinafter. In the process of the present invention for the preparation of toner particles which comprises subjecting a resin which can be rendered self-emulsifiable upon neutralization to phase inversion emulsification to produce particles in an aqueous medium, a finely particulate wax which has previously been dispersed in a predetermined particle size can be subjected to phase inversion emulsification at the same time with the resin and colorant to obtain a encapsulated spherical toner particle having a finely particulate wax and a colorant encapsulated therein.

Whether or not the finely particulate wax is encapsulated in the spherical toner particle thus obtained can be confirmed, e.g., by embedding toner particles into a resin, cutting it with microtome, dyeing the cut surface with ruthenium oxide, etc., and then observing it with TEM (transmission electron microscope). Further, whether or not the other additives such as a colorant is encapsulated therein could also be confirmed similarly.

The finely particulate wax may be encapsulated in the mixture as it is in the form of solid particle or in the form of aqueous dispersion. As the wax there is preferably used one insoluble in the organic solvent contained in the mixture.

As the wax employable herein there may be preferably used a compound having a relatively low softening point or melting point. Examples of the wax employable herein include waxes having a softening point (melting point) of from 40° to 130° C. such as petroleum wax of higher hydrocarbon (e.g., paraffin wax, microcrystalline wax), vegetable wax of higher ester (e.g., carnauba wax, candelilla wax, Japan wax, rice wax) and synthetic wax of higher hydrocarbon (e.g., polypropylene wax, polyethylene wax, Fischer-Tropsch wax). Waxes having different softening points (melting points) may be used in admixture.

The dispersion of the finely particulate wax in the resin which can be rendered self-emulsifiable upon neutralization can be accomplished by knead-dispersing the material during melt-kneading process as in the crushing method or by wet-dispersing the material. In the preparation process of the present invention, the wet-dispersion is desirable because it is simple in the process. The melt-kneading process is disadvantageous in that the finely particulate wax which has been dispersed in a desired particle size can be further finely dispersed or occasionally re-agglomerated.

In the wet-kneading process, either the simultaneous dispersion of a resin, a colorant, a finely particulate wax or its dispersion in a liquid medium or the dispersion of a resin and a colorant, followed by the dispersion of a finely particulate wax or its dispersion in a liquid medium, may be employed. The latter method is preferred to the former because it has less adverse effect on the granulating properties during phase inversion emulsification. In the former process, highly hydrophobic components such as wax are adsorbed by the colorant, possibly giving some adverse effects on the formation of particles during phase inversion emulsification.

In accordance with the preparation process of the present invention, an aqueous dispersion of a finely particulate wax comprising the foregoing wax dispersed in a liquid medium in a predetermined particle size may be preferably used.

The softening point (melting point) of the wax to be used in the present invention may be from 40° C. to 130° C., preferably from 60° C. to 120° C. If the softening point of the wax falls below 40° C., the resulting toner leaves something to be desired in blocking resistance or storage stability. On the contrary, if the softening point of the wax exceeds 130° C, the resulting toner disadvantageously exhibits too high a fixing starting temperature.

The amount of the wax to be added is from 1% to 30% by weight, preferably from 2% to 20% by weight, as calculated in terms of solid content based on the solid content of the resin which can be rendered self-emulsifiable upon neutralization. If the amount of the wax falls below 1% by weight, the effect of the wax cannot be sufficiently exerted. On the contrary, if the amount of the wax exceeds 30% by weight, the resin disadvantageously cannot have the finely particulate wax sufficiently encapsulated therein, deteriorating the developability of the toner.

The particle size of the finely particulate wax to be added is preferably predetermined smaller than that of the toner particle to be obtained. It is normally from 0.1 to 3 $\mu$m, preferably from 0.2 to 2 $\mu$m. If the particle size of the finely particulate wax falls below 0.1 $\mu$m, the finely particulate wax melts and comes out on the surface of the toner particle during melting, making it impossible to exert a sufficient releasing effect, even if the content of the wax is raised. On the contrary, if the particle size of the finely particulate wax exceeds 3 $\mu$m, the content of the wax in the toner particle is nonuniform or the wax is exposed on the surface of the toner particle, deteriorating the developability of the toner.

The preparation process of the present invention involving the use of a mixture containing a finely particulate wax for phase inversion emulsification has the following characteristics:

1) The dispersion of a finely particulate wax which has previously been controlled to have a desired particle size in a resin solution which does not dissolve and swell the finely particulate wax makes it easy to control the particle size of the finely particulate wax. Needless to say, the dispersed particle size of the finely particulate wax has a great effect on the releasing effect during fixing. In the melt-kneading process in the crushing method, the releasing effect during fixing is restricted by the kind or softening point (melting point) of the wax used, making it difficult to prepare the desired toner particle. In particular, the incorporation of the finely particulate wax in the toner particle makes it possible to use a wax having a relatively low softening point (melting point) which would be difficult to prepare in the crushing method or polymerization method.
2) According to the phase inversion emulsification method of the present invention, the state in the organic phase (a mixture for use in the phase inversion emulsification) such that a colorant or wax is dipsersed is maintained even in the toner particle formed and therefore, the colorant or wax does not agglomerate within the toner particle.
3) In accordance with the phase inversion emulsification method, the hydrophilicity and hydrophobicity of the resin are properly balanced to produce particles. Accordingly, hydrophobic components such as colorant and wax can be encapsulated in the toner particle. The resulting toner is little liable to deterioration of developability due to wax.

In accordance with the preparation process of the present invention, the foregoing characteristics make it possible to provide a powder toner having a low temperature fixability and excellent anti-hot offset properties, anti-curling property and developability.

According to the process using a wax fine particle of the present invention, a toner particle obtained can be greatly improved in the hot-offset resistance and curling property as compared with the toner particle free of a wax.

The toner particle comprising a colored resin particle comprising a binder resin having encapsulated therein a colorant may contain a charge control agent reduced in the fear of environmental pollution. For example, a resin covering layer having dissolved or finely dispersed therein a charge control agent may be formed on the surface of a toner particle. In this particle, a charge control agent is localized on the surface of a toner particle as a whole including the covering layer.

The thus-obtained powder toner particle can be used by itself as an electrophotographic toner, however, in general, it is preferably used as an electrophotographic toner after the external addition of a metal oxide fine particle.

The third invention and the fourth invention are described in detail below.

The spherical toner comprising a binder resin having encapsulated therein a colorant and a wax formed by the phase inversion emulsification has fairly different triboelectricity from the amorphous toner formed by the grinding method. More specifically, in the case of a toner by the grinding method, a colorant, a charge control agent or a wax partly comes out on the surface of a particle and this greatly affect the triboelectricity of the toner. Accordingly, the toner formed by the grinding method exhibits quite different behavior from the toner having encapsulated therein a colorant or the like as the objective of the present invention even though raw materials such as a binder resin and a colorant are the same.

In the spherical toner as the objective of the present invention, due to the presence of a hygroscopic polar group on the surface of a particle, the toner cannot have a satisfactory environmental stability (degree of stability in the charge amount against change of the temperature or humidity) and the charge amount is greatly reduced particularly at a high humidity, which gives rise to a trouble in practice.

Further, the toner as the objective of the present invention is spherical and accordingly, when a carrier or the like is used as in the case of using a two-component development system, the triboelectric charging with a carrier or the like is generated by the point contact and the efficiency is duly assumed to be low as compared with the case of an amorphous toner formed by the grinding method or the like where the triboelectric charging is generated by the plane contact. This is considered to be responsible for the fact that the charge rising is slow (a long time is necessary for reaching the saturated charge amount) and the charge amount distribution at the rising is deficient in the uniformity.

In the third and fourth inventions of the present invention, external addition as described below is applied and the above-described problems can be overcome.

In obtaining a negatively polar toner, a metal oxide fine particle smaller than the average particle size of the toner particles and subjected to surface treatment with an organic compound having a trifluoromethyl group is externally added to the surface of a toner particle comprising a spherical colored resin particle comprising a binder resin having encapsulated therein a colorant, thereby preparing an electrophotographic negatively polar toner.

By externally adding a metal oxide fine particle subjected to surface treatment with an organic compound having a trifluoromethyl group to the surface of a spherical toner particle of the present invention, the environmental stability of charging is outstandingly improved and when the toner is used as an electrophotographic negatively polar toner in a copying machine or printer, a good image can be obtained.

The term "a metal oxide fine particle subjected to surface treatment with an organic compound having a trifluoromethyl group" as used in the present invention is described below.

The metal oxide fine particle indicates a fine particle of a metal oxide such as titanium oxide, aluminum oxide, silicon oxide, zinc oxide, tin oxide, antimony oxide or magnesium oxide, having an average particle size of about 1 $\mu$m or less, preferably approximately from 5 to 100 nm. Among these metal oxide fine particles, a fine particle of titanium oxide is practically suitable because the fine particle itself has almost neutral triboelectricity and cheap fine particles having an average particle size of from 5 to 100 nm can be easily available.

The term "organic compound having a trifluoromethyl group" as used in the present invention means an organic compound (including a polymer) having at least —$CF_3$ group in the molecular structure and a perfluoroalkyl acrylate resin or an alkoxysilane, alkylsilane or chlorosilane compound having a perfluoroalkyl group is preferably used. Specific examples thereof are set forth below.

Dicguard NH-15 (toluene dispersion of $CF_3$—$(CF_2)_7$— containing acrylate resin available from Dainippon Ink & Chemicals, Inc.)

$CF_3$—$(CH_2)_9$—$Si(OCH_3)_3$ $CF_3$—$(CH_2)_2$—$Si(OCH_3)_3$ $CF_3$—$(CF_2)_7$—$(CH_2)_2$—$Si(OCH_3)_3$ $CF_3$—$(CF_2)_7$—$(CH_2)_2$—$Si(CH_3)$ $(OCH_3)_2$ $CF_3$—$(CF_2)_7$—$(CH_2)_2$—$Si(CH_3)_3$ $CF_3$—$(CF_2)_7$—$(CH_2)_2$—$SiCl_3$ $CF_3$—$(CF_2)_7$—$SO_2NH$ $(CH_2)_3NH_2$

The surface treatment of a metal oxide fine particle with the organic compound having a trifluoromethyl group may be performed by a method such that the organic compound is dissolved in a toluene- or alcohol-base organic solvent and thoroughly mixed with a metal oxide fine particle and after removing the organic solvent by distillation or the like, the mixture is heat-treated and crushed.

The amount of the organic compound having a trifluoromethyl group for use in the surface treatment of a metal oxide fine particle is suitable from 5 to 30% by weight based on the metal oxide fine particle. So far as the amount externally added is the same, as the amount of the organic compound used in the surface treatment of the metal oxide fine particle is larger, the toner charge amount is liable to increase and therefore, the amount of the organic compound used in the surface treatment is preferably controlled according to the use purpose.

The metal oxide fine particle surface-treated with an organic compound having a trifluoromethyl group can be externally added in an amount, for example, of from 0.05 to 3% by weight based on the spherical colored resin particle.

The organic compound having a trifluoromethyl group exhibits strong water repellency because the surface energy of the trifluoromethyl group is extremely low and at the same time, because of the property such that the compound becomes highly negative on the friction, an effect of considerably increasing the negative charging of the toner is exerted. As a result, the toner having externally added thereto a metal oxide fine particle surface-treated with an organic compound having a trifluoromethyl group is greatly improved in the environmental stability and also outstandingly improved in the charge rising property (the rate for reaching the saturated charge amount).

In externally adding a metal oxide fine particle surface-treated with an organic compound having a trifluoromethyl group to the surface of a spherical toner particle comprising a binder resin having encapsulated therein a colorant, a silica fine particle may be externally added in combination, if desired.

In the case of using a metal oxide fine particle surface-treated with an organic compound having a trifluoromethyl group and a silica fine particle in combination, either particle can be externally added in an amount, for example, of from 0.05 to 3% by weight based on the spherical colored resin particle. The weight ratio of the metal oxide fine particle to the silica fine particle is not particularly limited, however, it is usually from 80/20 to 20/80, preferably from 70/30 to 30/70.

The silica fine particle is preferably silica having an average primary particle size of approximately from 5 to 50 nm and having hydrophobicity. A large number of such silica fine particles are commercially available as described later and it may be convenient to use these in practice.

In the present invention, an electrically conductive fine particle and a hydrophobic silica fine particle, each being smaller than the average particle size of the toner particles, are externally added to the surface of a toner particle comprising a spherical colored resin particle comprising a binder resin having encapsulated therein a colorant to prepare an electrophotographic toner.

By externally adding an electrically conductive fine particle and a hydrophobic silica fine particle to the surface of the spherical toner particle according to the present invention, the charge rising and the uniformity of charging can be greatly improved.

The electrically conductive fine particle for use in the present invention is not particularly limited as long as the fine particle has electric conductivity and examples thereof include a titanium oxide fine particle surface-treated with tin oxide~antimony, a stannic oxide fine particle doped with antimony and a stannic oxide fine particle. The electrically conductive fine particle preferably has an average primary particle size of about 1 $\mu$m or less, more preferably from 10 to 800 nm, still more preferably from 10 to 500 nm.

Examples of the commercially available electrically conductive titanium oxide fine particle treated with tin oxide-antimony include EC-300 (produced by Titan Kogyo K. K.), ET-300, HJ-1, JI-2 (all produced by Ishihara Sangyo Kaisha, Ltd.) and W-P (produced by Mitsubishi Materials Corporation).

Examples of the commercially available electrically conductive tin oxide doped with antimony include T-1 (produced by Mitsubishi Materials Corporation) and SN-100P (produced by Ishihara Sangyo Kaisha, Ltd.).

Examples of the commercially available stannic oxide include SH-S (produced by Nihon Kagaku Sangyo Co., Ltd.).

In the present invention, an electrically conductive fine particle is used and in particular, an electrically conductive fine particle having hydrophobicity is suitably used. The term "hydrophobicity" as used herein can be evaluated by the methanol hydrophobicization degree (the % by volume of methanol necessary for completely wetting the powders floating on the water surface). An electrically conductive fine particle having the value of about 20% or more is used.

Such an electrically conductive fine particle can be obtained through hydrophobicization which is preferably performed by such a method that the above-described electrically conductive fine particle such as a titanium oxide fine particle surface-treated with tin oxide~antimony, a stannic oxide fine particle doped with antimony or a stannic oxide fine particle, is added to a hydrophobicizer solution while stirring and after homogeneously mixing it, the mixture is heated and crushed or the above-described electrically fine particle is mixed with a hydrophobicizer and an organic solvent/water to present a homogenous dispersion state and after removing the organic solvent by distillation or the like, the mixture is heated and crushed.

The hydrophobicizer is not particularly limited and any material may be used as long as the material itself or a reaction product or hydrolysate thereof exhibits hydrophobicity. Preferred examples thereof include various organic silicon compounds, titanate-base coupling agents, aluminum-base coupling agents, fluorine-base organic compounds and fluororesins such as fluoro(meth)acrylate (co) polymer.

Examples of the organic silicon compound include various silicone oils and silane coupling agents such as organochlorosilane (e.g., trichloromethylsilane, dichlorodimethylsilane, chlorotrimethylsilane, trichloroethylsilane, dichlorodiethylsilane, chlorotriethylsilane, chlorotriphenylsilane), organosilazane (e.g., triethylsilazane, triphenylsilazane, hexaethyldisilazane, hexamethyldisilazane) and organoalkoxysilane (e.g., dimethoxydimethylsilane, trimethoxymethylsilane).

Examples of the titanate-base coupling agents include isopropyltriisostearoyl titanate and isopropyltris(dioctylpyrophoshate) titanate. Examples of the aluminum-base coupling agent include acetoalkoxyaluminum diisopropylate.

The fluorine-containing organic compound is an organic compound (including polymers) containing at least —$CF_3$ group in the molecule structure and perfluoroalkyl acrylate resin or perfluoroalkyl-containing alkoxysilane, alkylsilane or chlorosilane compound may be suitably used. Specific examples thereof are described above.

The silica fine particle for use in the present invention is not particularly limited as long as the silica has an average primary particle size of approximately from 5 to 100 nm, however, preferred is a hydrophobic silica having an average primary particle size of from 5 to 50 nm, preferably subjected to the surface treatment for hydrophobicization and having a methanol hydrophobicization degree of about 20% or more. The hydrophobicization may be performed by a generally known method as used for the above-described electrically conductive fine particle, however, it is convenient to use commercially available hydrophobic silica fine particles.

Examples of the commercially available hydrophobic silica fine particle which can be suitably used in the present invention include HDK, H2000, HDKH1303 (all produced by Wacker Chemicals East Asia Co., Ltd.), SLM 50650 (produced by Hoechst Japan Limited), R972, R976, RX200, RX170, NAX50 and RY200 (all produced by Nippon Aerosil Co., Ltd.).

The electrically conductive fine particle and the silica fine particle each is added in an amount of from 0.05 to 3% by weight based on the spherical colored resin particle. The weight ratio of the electrically conductive fine particle to the silica fine particle is not particularly limited but it is usually from 80/20 to 20/80, preferably from 70/30 to 30/70.

The reason why the spherical toner of the present invention is improved in the charge rising property by externally adding an electrically conductive fine particle and a hydrophobic silica fine particle is not clarified, however, the present inventors presume it as follows.

The spherical toner comprising a binder resin having encapsulated therein a colorant has high insulating effect on the surface thereof and therefore, the charge generated by the friction is difficult to smoothly transfer/exchange to the toner particle present in the vicinity thereof. When a certain degree of electrical conductivity is imparted to the surface of a toner particle, the charge amount itself is reduced, however, movement~exchange of a charge among toner particles in the vicinity proceeds at an increased rate, as a result, the time required for reaching the saturation charge amount is shortened and the uniformity of the charge amount distribution is elevated.

However, since the electrically conductive fine particle such as titanium oxide and tin oxide is hydrophilic, satisfactory environmental stability as the toner cannot be necessarily achieved by the external addition of the electrically conductive fine particle, but when the surface of the electrically conductive fine particle is subjected to hydrophobicization, good charge rising property and good environmental stability can be attained.

The external addition is not particularly limited but may be performed by a commonly known method using a Henschel mixer or Hybridizer. When two or more kinds of external additives are used, these may be externally added in parts through two or several stages or may be mixed and externally added batchwise.

With respect to the particle size of the electrophotographic toner particle comprising the toner particle for use in the present invention, any size can be selected within the practical level as the toner, more specifically, any size may be selected within the range such that the volume-average particle size is approximately from 3 to 12 $\mu$m. However, in view of matching with currently used machines, those having a volume-average particle size of from 6 to 12 $\mu$m are preferred.

The toner of the present invention has a bulk specific gravity (g/cm$^3$) of 0.25 or more. By externally adding an external additive such as a metal oxide fine particle (e.g., silica) to the toner primary body comprising a spherical particle, the powder after the external addition has a bulk specific gravity larger than that before the external addition. In the present invention, this bulk specific gravity has the same meaning as the aerated bulk density. A larger aerated bulk density is generally preferred, however, in the present invention, the aerated bulk density is preferably 0.35 g/cm$^3$ or more, more preferably 0.4 g/cm$^3$ or more. Typically, the toner is preferably formed to have an aerated bulk density of 0.35 g/cm$^3$ or more, more preferably 0.4 g/cm$^3$ or more, by externally adding an external additive such as a metal oxide fine particle (e.g., silica) to a primary body toner particle having an aerated bulk density of from 0.25 to less than 0.35 g/cm$^3$. That the aerated bulk density is large means that the toner has excellent powder fluidity and the spherical toner particle has no or a very small amount of void, which corresponds to the fact that the toner particle has a more excellent mechanical strength against the external stress. For preparing a toner particle having a large aerated bulk density, the above-described phase inversion emulsification method using an in-situ resin is suitable.

The thus-obtained powder toner can be used as a non-magnetic one-component developer for the development of an electrostatic image or after combining with a carrier, as a two-component developer. When the powder toner obtained mainly contains magnetic powder as a colorant, it may be used as a magnetic one-component developer.

As the carrier there may be used any known conventional carrier. Examples of the carrier employable herein include powder of metal such as iron, nickel, copper, zinc, cobalt, manganese, chromium and rare earth metal, alloy or oxide thereof and surface-treated glass and silica. Needless to say, a resin-coated carrier such as acrylic resin-coated carrier, fluororesin-coated carrier and silicone resin-coated carrier may be used. The carrier employable herein may have a particle size of from about 20 to 200 $\mu$m. As the average particle size of the carrier, it is suitably, for example, from about 30 to 200 $\mu$m.

In order to obtain a two-component electrostatic developer from the toner obtained according to the preparation process of the present invention and the foregoing carrier, the toner may be used in a mixing proportion of from 1 to 15 parts by weight based on 100 parts by weight of the carrier used.

[Practical embodiment of the present invention]

The present invention can be implemented in the following embodiments:

1. An electrophotographic toner comprising a particulate material having a colorant encapsulated in a binder resin, wherein said binder resin is a non-crosslinked styrene-acrylic resin having a molecular weight of not less than 200,000 in a proportion of from 5 to 60% by weight in terms of polystyrene by gel permeation chromatography (GPC), a weight-average molecular weight Mw to number-average molecular weight Mn ratio (Mw/Mn) of from 4 to 30 and an acid value of from 30 to 120 mg (KOH)/g and said toner comprising a particulate material has a Wadell's practical sphericity of not less than 0.95, a bulk specific gravity of not less than 0.25 $cm^3$/g and a volume-average particle size of from 3 to 12 $\mu$m.

2. The electrophotographic toner as described in Clause 1, wherein said particulate material comprises a finely particulate wax with said colorant encapsulated in said binder resin.

3. A process for the preparation of an electrophotographic toner having a Wadell's practical sphericity of not less than 0.95 and a volume-average particle size of from 3 to 12 $\mu$m, which comprises subjecting a mixture of a colorant, a resin which can be rendered self-emulsifiable upon neutralization and an organic solvent as essential components to phase inversion emulsification in an aqueous medium in the presence of a neutralizer in an amount sufficiently large to render said resin self-emulsifiable to produce in said aqueous medium a particulate material comprising a colorant encapsulated in a binder resin, and then separating and drying said particulate material, wherein said resin which can be rendered self-emulsifiable upon neutralization is a non-crosslinked styrene-acrylic resin having a molecular weight of not less than 200,000 in a proportion of from 5 to 60% by weight in terms of polystyrene as determined by gel permeation chromatography (GPC), a weight-average molecular weight Mw to number-average molecular weight Mn ratio (Mw/Mn) of from 4 to 30 and an acid value of from 30 to 120 mg (KOH)/g and said toner comprising a particulate material has a bulk specific gravity of not less than 0.25 $cm^3$/g.

4. The preparation process as described in Clause 3, wherein said styrene-acrylic resin is obtained by mixing two or more non-crosslinked styrene-acrylic resins having different weight-average molecular weights which are compatible with each other.

5. The preparation process as described in Clause 3 or 4, wherein said resin which can be rendered self-emulsifiable upon neutralization is a styrene-acrylic resin having an acid value of from 30 to 120 mg (KOH)/g obtained by polymerizing one of two or more different mixtures of addition-polymerizable monomers, at least one of said mixtures comprising styrene and/or (meth)acrylic acid ester and the whole of said mixtures comprising styrene and (meth)acrylic acid ester, in a reaction vessel until the conversion reaches a range of from 20% to 80%, and then adding the other to the polymerization system in the same reaction vessel to cause further polymerization.

6. The preparation process as described in Clause 3 or 4, wherein said resin which can be rendered self-emulsifiable upon neutralization is a styrene-acrylic resin having an acid value of from 30 to 120 mg (KOH)/g comprising components having a molecular weight of from 80,000 to 500,000 and from 6,000 to 60,000, respectively, obtained by polymerizing one of two or more different mixtures of addition-polymerizable monomers, at least one of said mixtures comprising styrene and/or (meth)acrylic acid ester and the whole of said mixtures comprising styrene and (meth)acrylic acid ester, in a reaction vessel until the conversion reaches a range of from 20% to 80%, and then adding the other to the polymerization system in the same reaction vessel to cause further polymerization.

7. The preparation process as described in any one of Clauses 3 to 6, wherein said various resin mixtures are prepared such that the glass transition temperature of the resin produced when it is assumed that the addition-polymerizable monomers in the mixture to be first polymerized have been reacted in a proportion of 100% is lower than that of the resin produced when it is assumed that the addition-polymerizable monomers in the resin to be subsequently polymerized in the same reaction vessel are reacted in a proportion of 100%.

8. The preparation process as described in any one of Clauses 3 to 7, wherein an aqueous dispersion of a finely particulate wax having a smaller particle size than the toner particle to be produced.

9. The preparation process as described in any one of Clauses 3 to 8, wherein if there are used two mixtures of addition-polymerizable monomers, the weight proportion of said mixtures (A) and (B) is from 70/30 to 30/70.

10. The preparation process as described in any one of Clauses 3 to 9, wherein as said two or more mixtures of addition-polymerizable monomers there are used ones having an acid value of from 30 to 120 mg (KOH)/g.

11. The preparation process as described in any one of Clauses 3 to 10, wherein the polymerization reaction is effected by a solution polymerization process in the presence of a solvent having SP value of not less than 9 as a reaction solvent.

12. The preparation process as described in any one of Clauses 3 to 11, wherein the polymerization reaction is effected by a solution polymerization process in the presence of a solvent having SP value of not less than 9 and comprising water incorporated therein in an amount of from 0.5 to 30% by weight as a reaction solvent.

13. The preparation process as described in any one of Clauses 3 to 12, wherein said resin which can be rendered self-emulsifiable upon neutralization obtained by polymerizing one of two or more mixtures of addition-polymerizable monomers which produce resins having different glass transition temperatures in a reaction vessel, and then polymerizing the other in the same reaction vessel is a non-crosslinked resin.

14. An electrophotographic toner which is a spherical particle comprising a binder resin having encapsulated therein a colorant and has a volume average particle size of from 3 to 12 $\mu$m, said binder resin being a non-crosslinked styrene-acrylic resin having an acid value of from 30 to 120, said resin containing from 5 to 60% by weight of the components having a molecular weight in terms of polystyrene by gel permeation chromatography of 200,000 or more and said resin having a ratio (Mw/Mn) of the weight-average molecular weight Mw to the number-average molecular weight Mn of from 4 to 30.

15. The electrophotographic toner as described in Clause 14, wherein the non-crosslinked styrene-acrylic resin having an acid value of from 30 to 120 as the binder resin contains from 10 to 60% by weight of the components having a molecular weight in terms of polystyrene by gel permeation chromatography of 200,000, said resin has a ratio (Mw/Mn) of the weight-average molecular weight Mw to the number-average molecular weight Mn of from 4 to 30, and the volume average particle size is from 3 to 12 $\mu$m.

16. The electrophotographic toner as described in Clause 14 or 15, wherein the spherical particle is a spherical particle having an average roundness of 0.97 or more, the non-crosslinked styrene-acyl resin having an acid value of from 30 to 120 as the binder resin contains from 10 to 60% by weight of the components having a molecular weight in terms of polystyrene by gel permeation chromatography of 200,000 or more, and the toner has an aerated bulk density of 0.35 g/cm$^3$ or more.

17. The electrophotographic toner as described in any one of Clauses 14 to 16, wherein the spherical particle is a particle comprising a binder resin having encapsulated therein a finely particulate wax together with a colorant.

18. The electrophotographic toner as described in any one of Clauses 14 to 17, wherein a metal oxide fine particle surface-treated with an organic compound having a trifluoromethyl group is externally added.

19. The electrophotographic toner as described in Clause 18, wherein the metal oxide fine particle is titanium oxide having an average particle size of from 5 to 100 nm.

20. The electrophotographic toner as described in any one of Clauses 14 to 17, wherein an electrically conductive fine particle and a hydrophobic silica fine particle are externally added.

21. A process for preparing an electrophotographic toner comprising spherical particles having a volume average grain size of from 3 to 12 $\mu$m, the process comprising mixing a mixture comprising a colorant, a resin which can be rendered self-emulsifiable upon neutralization and an organic solvent as essential components with an aqueous medium in the presence of a neutralizer in an amount sufficiently large to render said resin self-emulsifiable to effect phase inversion emulsification, thereby producing particles each comprising a binder resin having encapsulated therein a colorant and a wax in the liquid medium, and separating and drying the particles, wherein said resin which can be rendered self-emulsifiable upon neutralization is a non-crosslinked styrene-acrylic resin having an acid value of from 30 to 120, and said resin contains from 5 to 60% by weight of the components having a molecular weight in terms of polystyrene by gel permeation chromatography of 200,000 or more and has a ratio (Mw/Mn) of the weight-average molecular weight Mw to the number-average molecular weight Mn of from 4 to 30.

22. The process for preparing an electrophotographic toner as described in Clause 21, wherein the spherical particle is a spherical particle having an average roundness of 0.97 or more, the non-crosslinked styrene-acrylic resin having an acid value of from 30 to 120 as the binder resin contains from 10 to 60% by weight of the components having a molecular weight in terms of polystyrene by gel permeation chromatography of 200,000 or more, and the toner has an aerated bulk density of 0.35 g/cm$^3$ or more.

23. The preparation process as described in Clause 21 or 22, wherein the styrene-acrylic resin is obtained by mixing two or more non-crosslinked resins compatible with each other and different in the weight-average molecular weight.

24. The preparation process as described in any one of Clauses 21 to 23, wherein the resin which can be rendered self-emulsifiable upon neutralization is a styrene-acrylic resin having an acid value of from 30 to 120 and obtained from two or more different mixtures of addition-polymerizable monomers by in-situ polymerizing at least one mixture out of said plurality of mixtures until the polymerization rate reaches from 20 to 80% and then adding and polymerizing another mixture in the same reaction vessel, the mixtures being prepared such that at least one of the mixtures contains styrene and/or (meth)acrylic acid ester and the mixtures in total contain styrene and (meth)acrylic acid ester.

25. The preparation process as described in any one of Clauses 21 to 24, wherein the resin which can be rendered self-emulsifiable upon neutralization is a styrene-acrylic resin which contains components having a molecular weight of from 80,000 to 500,000 or from 6,000 to 60,000, has an acid value of from 30 to 120 and is obtained from two or more different mixtures of addition-polymerizable monomers by in-situ polymerizing at least one mixture out of said plurality of mixtures until the polymerization rate reaches from 20 to 80% and then adding and polymerizing another mixture in the same reaction vessel, the mixtures being prepared such that at least one of the mixtures contains styrene and/or (meth)acrylic acid ester and the mixtures in total contain styrene and (meth)acrylic acid ester.

26. The preparation process as described in any one of Clauses 21 to 25, wherein respective mixtures used are prepared such that the Tg of the product resin determined on the assumption that 100% of the addition-polymerizable monomers in the mixture first polymerized are reacted is lower than the Tg of the product resin determined on the assumption that 100% of the addition-polymerizable monomers in the mixture subsequently added to the same reaction vessel are reacted.

27. The preparation process as described in any one of Clauses 21 to 26, wherein an aqueous dispersion solution of finely particulate wax each being smaller than the particle size of the toner particles to be produced is used in combination.

The present invention will be further described hereinafter with reference to a preferred embodiment thereof.

A mixture of two or more addition-polymerizable monomers and a radical polymerization initiator, free of crosslinkable addition-polymerizable monomer, having an acid value of from 30 to 120 which can produce a polymer having a glass transition temperature of from 0° C. to 60° C. is polymerized in the presence of a reaction vessel (water content: 5 to 30% by weight) containing an organic solvent having SP value of not less than 9 and a water-soluble or partly-water soluble organic solvent, which reaction solvent doesn't dissolve a wax described later therein, in a reaction vessel until the conversion reaches 20% to 80% (weight-average molecular weight Mw: 80,000 to 500,000).

Subsequently, another mixture of two or more addition-polymerizable monomers and a radical polymerization initiator, free of crosslinkable addition-polymerizable monomer, having an acid value of from 30 to 120 which can produce a polymer having a glass transition temperature as higher than produced from the former mixture as from 45° C. to 80° C. is polymerized in the same reaction vessel until the unreacted monomers have been polymerized as fully as possible to obtain a weight-average molecular weight Mw of from 6,000 to 60,000. Eventually, a solution of a resin which can be rendered self-emulsifiable upon neutralization, made of styrene-(meth)acrylic acid-(meth)acrylic acid copolymer, having an acid value of from 30 to 120 and relatively many regions of a weight-average molecular weight of from 30,000 to 80,000, is obtained [weight-average molecular weight as a whole: 80,000 to 180,000; final glass transition temperature: 50° C. to 70° C.; nonvolatile content: 30 to 70% by weight].

An organic or inorganic pigment insoluble in the foregoing solvent is then mixed with and dispersed in the foregoing uncrosslinked styrene-(meth)acrylic acid ester-(meth) acrylic acid copolymer quite free of crosslinked moiety in an amount of from 5 to 15 parts by weight based on 100 parts by weight of the solid content of the foregoing resin to obtain a homogeneous mixture 1.

Subsequently, a homogeneous stable aqueous medium dispersion (emulsion) of at least a finely particulate wax having a softening point (melting point) of from 40° C. to 130° C and an average particle size of from 0.1 to 3 μm having an affinity for but insoluble (non-compatible with) in the solvent and copolymer in the mixture 1 selected from the group consisting of synthetic wax of higher hydrocarbon, petroleum wax of higher hydrocarbon and vegetable wax of higher ester, which dispersion contains no dispersion stabilizer or, if any, an extremely small amount of a dispersion stabilizer and may contain an organic solvent, is prepared.

To the mixture 1 is then added the foregoing aqueous medium dispersion of wax in an amount of from 3 to 12 parts by weight based on 100 parts by weight of the solid resin content thereof as calculated in terms of nonvolatile content of finely particulate wax. The mixture is then subjected to stirring and dispersion to obtain a mixture 2 with an organic solvent comprising a finely particulate wax and a colorant dispersed in a resin which can be rendered self-emulsifiable upon neutralization with a base.

To the mixture 2 is then added an aqueous solution of a base in an amount such that the percent neutralization of the foregoing resin reaches 5 to 20% to obtain a homogeneous mixture 3. The temperature of the mixture 3 and the aqueous medium to be subjected to phase inversion emulsification are arranged as close to each other as possible within a range of from 5° to 40° C.

To the mixture 3 is then added dropwise an aqueous medium with stirring to cause phase inversion emulsification.

During this procedure, the temperature of the mixture 3 and the aqueous medium are arranged as close to each other as possible. In this manner, an aqueous medium dispersion of a spherical toner particle having an average particle size of from 3 to 12 μm comprising a particulate pigment and a finely particulate wax dispersed in the foregoing resin is obtained.

The aqueous medium dispersion of a spherical toner particle thus obtained is desolvated to obtain an aqueous dispersion (containing no solvent or, if any, an extremely small amount of a solvent) of a spherical toner particle from which the toner particle is then withdrawn by filtration. The toner particle thus withdrawn is re-dispersed in water. To the aqueous dispersion is then added an aqueous solution of acid. The mixture is then thoroughly stirred to convert the self-emulsifiable resin contained in the spherical toner particle which has been neutralized with a base back to a resin which can be rendered self-emulsifiable upon neutralization.

The liquid medium comprising a toner particle incorporated therein is repeatedly washed to separate therefrom the toner particle alone which is then dried to obtain a electrophotographic toner made of spherical particles comprising a pigment and a finely particulate wax encapsulated in a resin which can be rendered self-emulsifiable upon neutralization.

The present invention will be further described in the following examples and comparative examples. The term "parts" and "%" as used hereinafter are by weight.

(REFERENCE EXAMPLE 1)

Synthesis of styrene-acrylic copolymer containing carboxyl group

Into a 3-l flask equipped with a dropping apparatus, a thermometer, a nitrogen gas intake pipe, an agitator and a reflux condenser were charged 1,000 parts of methyl ethyl ketone. To the content of the flask was then added dropwise a mixture of the following monomers and polymerization initiator at a temperature of 80° C. in 2 hours.

Styrene 600 parts

2-Ethylhexyl acrylate 143 parts

Methyl methacrylate 180 parts

Acrylic acid 77 parts

"Perbutyl O" 10 parts

Every 3 hours after the completion of the dropwise addition, 3 parts of "Perbutyl O" (radical polymerization initiator, produced by NOF Corporation) were added to the system three times. The reaction continued for 4 hours before termination. Methyl ethyl ketone was then added to the system in such an amount that the nonvolatile content of the system was adjusted to 50% to obtain a resin solution. The resin thus obtained exhibited a glass transition temperature of 70° C., a weight-average molecular weight of 52,000 and an acid value of 60. The resin thus obtained will be hereinafter referred to as "R-1".

(R-1) contained less than 4% of components having a molecular weight in terms of polystyrene by gel permeation chromatography (GPC) of 200,000 or more and had a ratio (Mw/Mn) of the weight-average molecular weight Mw to the number-average molecular weight Mn of 3.

(REFERENCE EXAMPLE 2)

Synthesis of styrene-acrylic copolymer having carboxyl group:

Into a 3 l-volume flask equipped with a dropping apparatus, a thermometer, a nitrogen gas intake pipe, an agitator and a reflux condenser, 667 parts of methyl ethyl ketone was charged, and thereto, a mixture of the monomers shown below and a polymerization initiator was added dropwise at 80° C. over 2 hours.

Styrene 608 parts

Butyl acrylate 302 parts

Acrylic acid 90 parts

"Perbutyl O" 4 parts

After completion of the dropwise addition, 3 parts of "Perbutyl O" (radical polymerization initiator, produced by NOF Corporation) was added every 3 hours three times. The reaction was continued for 4 hours and then terminated. The nonvolatile content was adjusted to 50% with methyl ethyl ketone to obtain a resin solution. The resin obtained had a glass transition temperature of 57° C., a weight-average molecular weight of 115,000 and an acid value of 70. This is hereinafter referred to as "R-2".

(R-2) contained 5.3% of components having a molecular weight in terms of polystyrene by gel permeation chromatography (GPC) of 200,000 or more and had a ratio (Mw/Mn) of the weight-average molecular weight Mw to the number-average molecular weight Mn of 2.57.

(REFERENCE EXAMPLE 3)

Synthesis of styrene-acrylic copolymer containing carboxyl group

Into a 3-l flask equipped with a dropping apparatus, a thermometer, a nitrogen gas intake pipe, an agitator and a reflux condenser were charged a 114/12/24 (by parts) mixture of methyl ethyl ketone, isopropyl alcohol and water. The content of the flask was heated to a temperature of 80° C. where a mixture of the following monomers and polymerization initiator was charged into the flask at once to initiate reaction.

Composition 1

Styrene 330 parts

Butyl acrylate 216 parts

Acrylic acid 54 parts

"Perbutyl O" 0.6 part

After 3 hours, about 10 parts of the reaction resin solution were sampled, diluted with the same amount of methyl ethyl ketone, and then measured for viscosity by means of a Gardener viscometer every 1 hour. When the viscosity reached P-Q, a 567/63 (by parts) mixture of methyl ethyl ketone and isopropyl alcohol was added to the system. When the temperature of the system reached 80° C., a mixture of the following compounds was then added dropwise to the system in 1 hour. The percent residue of monomer was then determined by gas chromatography. From the results, the conversion at the 1st stage was calculated. The results were 60%.

Composition 2

Styrene 413 parts

Butyl acrylate 133 parts

Acrylic acid 54 parts

"Perbutyl O" 18 parts

Every 3 hours after the completion of the dropwise addition, 2 parts of "Perbutyl O" were added to the system three times. The reaction continued for 4 hours before termination. Methyl ethyl ketone was then added to the system in such an amount that the nonvolatile content of the system was adjusted to 50% to obtain a resin solution. The resin thus obtained will be hereinafter referred to as "R-3".

(REFERENCE EXAMPLE 4)

Synthesis of styrene-acrylic copolymer containing carboxyl group

Into a 3-l flask equipped with a dropping apparatus, a thermometer, a nitrogen gas intake pipe, an agitator and a reflux condenser were charged a 95/10/20 (by parts) mixture of methyl ethyl ketone, isopropyl alcohol and water. The content of the flask was heated to a temperature of 80° C. where a mixture of the following monomers and polymerization initiator was charged into the flask at once to initiate reaction.

Composition 1

Styrene 310 parts

Butyl acrylate 151 parts

Acrylic acid 39 parts

"Perbutyl O" 0.5 part

After 3 hours, about 10 parts of the reaction resin solution were sampled, diluted with the same amount of methyl ethyl ketone, and then measured for viscosity by means of a Gardener viscometer every 1 hour. When the viscosity reached P, a 473/53 (by parts) mixture of methyl ethyl ketone and isopropyl alcohol was added to the system. When the temperature of the system reached 80° C., a mixture of the following compounds was then added dropwise to the system in 1 hour. The percent residue of monomer was then determined by gas chromatography. From the results, the conversion at the 1st stage was calculated. The results were 62%.

Composition 2

Styrene 350 parts

Butyl acrylate 111 parts

Acrylic acid 39 parts

"Perbutyl O" 15 parts

Every 3 hours after the completion of the dropwise addition, 2 parts of "Perbutyl O" were added to the system three times. The reaction continued for 4 hours before termination. Methyl ethyl ketone was then added to the system in such an amount that the nonvolatile content of the system was adjusted to 50% to obtain a resin solution. The resin thus obtained will be hereinafter referred to as "R-4".

(REFERENCE EXAMPLE 5)

Synthesis of styrene-acrylic copolymer containing carboxyl group

Into a 3-l flask equipped with a dropping apparatus, a thermometer, a nitrogen gas intake pipe, an agitator and a reflux condenser were charged a 114/12/24 (by parts) mixture of methyl ethyl ketone, isopropyl alcohol and water. The content of the flask was heated to a temperature of 80° C. where a mixture of the following monomers and polymerization initiator was charged into the flask at once to initiate reaction.

Composition 1

Styrene 304 parts

Butyl acrylate 234 parts

Acrylic acid 62 parts

"Perbutyl O" 0.6 part

After 3 hours, about 10 parts of the reaction resin solution were sampled, diluted with the same amount of methyl ethyl ketone, and then measured for viscosity by means of a Gardener viscometer every 1 hour. When the viscosity reached P-Q, a 567/63 (by parts) mixture of methyl ethyl ketone and isopropyl alcohol was added to the system. When the temperature of the system reached 80° C., a mixture of the following compounds was then added dropwise to the system in 1 hour. The percent residue of monomer was then determined by gas chromatography. From the results, the conversion at the 1st stage was calculated. The results were 63%.

Composition 2

Styrene 404 parts

Butyl acrylate 134 parts

Acrylic acid 62 parts

"Perbutyl O" 18 parts

Every 3 hours after the completion of the dropwise addition, 2 parts of "Perbutyl O" were added to the system three times. The reaction continued for 4 hours before termination. Methyl ethyl ketone was then added to the system in such an amount that the nonvolatile content of the system was adjusted to 50% to obtain a resin solution. The resin thus obtained will be hereinafter referred to as "R-5".

All the in-situ resins (R-3) to (R-5) thus obtained had a molecular weight of not less than 200,000 in a proportion of from 5 to 30% by weight and showed a weight-average molecular weight (Mw) to number-average molecular weight (Mn) ratio (Mw/Mn) of from 5 to 10 in terms of polystyrene as determined by gel permeation chromatography (GPC).

TABLE 1

| Reference Example Sample | Reference Example 3 R-3 | Reference Example 4 R-4 | Reference Example 5 R-5 |
|---|---|---|---|
| Designed acid value (Composition 1/Composition 2) | 70/70 | 60/60 | 80/80 |
| Designed Tg (°C.) (Composition 1/Composition 2) | 25/50 | 35/50 | 20/50 |
| Weight ratio of monomers (Composition 1/Composition 2) | 50/50 | 50/50 | 50/50 |
| Conversion of Composition 1 (%) | 61 | 62 | 63 |
| Area ratio on GPC (Composition 1/Composition 2) | 28/72 | 30/70 | 30/70 |
| Mw (x 10,000) (Composition 1/Composition 2) | 36/3.5 | 32/3.3 | 38/3.6 |
| Mw (x 10,000) (as a whole) | 12.4 | 11.0 | 13.8 |
| Tg (°C.) | 61 | 61 | 60 |

Physical Properties of Resin:

* Acid value: weight in mg of KOH necessary for neutralizing 1 g of solid resin content

* Designed Tg: Tg determined on the assumption that 100% of polymerizable monomers were polymerized, calculated by Fox's equation (see *Phys. Soc.,* 1[3], 123(1956))

* Molecular weight:

in terms of polystyrene measured by gel permeation chromatography (GPC); the measurement conditions are shown below:

Apparatus: HLC-8020, manufactured by Tosoh Corporation

Measurement range: molecular weight of from 500 to 4,000,000 (in terms of polystyrene)

Reference polystyrene: produced by Tosoh Corporation

Mobile phase: THF

Flow rate: 1 ml/min

Concentration of specimen: Diluted with THF to 0.2%

Column: Tskgel Hx1 5000+3000+2000+1000, produced by Tosoh Corporation

Column constant temperature bath: 40° C.

Detector: RI

* Area ratio on GPC: ratio of areas separated with the border formed at the bottom in the chart determined

* Weight-average molecular weight by composition: weight-average molecular weight within each range separated above

* Weight-average molecular weight: weight-average molecular weight as an average of the entire resin

* Tg: Measured by differential scanning calorimetry (DSC)

Apparatus: DSC-50, manufactured by Shimadzu Corporation

Gas: helium (flow rate: 30 ml/min)

Rate of temperature increase: 10° C./min (COMPARATIVE EXAMPLE 1)

900 parts of the resin solution R-l obtained in Reference Example 1 and 50 parts of ELFTEX 8 (carbon black available from Cabot Inc. of USA) were kneaded by means of Type M-250 Eiger Motor Mill (motor mill available from Eiger Japan K.K.) for 1 hour. Methyl ethyl ketone was then added to the material in an amount such that the nonvolatile content thereof was adjusted to 51% to prepare a mill base (mixture A). The ratio of solid resin content to pigment in the mill base thus obtained was 90/10.

Subsequently, to 200 parts of the mixture A were added 9.2 parts of a 1N aqueous solution of sodium hydroxide and 24 parts of isopropyl alcohol. The mixture was kept at a temperature of 30° C. Under these conditions, deionized water was then added dropwise to the mixture with stirring to cause phase inversion emulsification. After 30 minutes, 300 parts of deionized water were added to the system.

The system was then subjected to distillation under reduced pressure to remove the organic solvent therefrom. A toner particle was then withdrawn from the residue by filtration, and then re-dispersed in water. Subsequently, the dispersion thus obtained was adjusted with a 0.1N aqueous solution of hydrochloric acid to pH 2. The dispersion was then stirred for 30 minutes to convert the resin in the toner particle to a resin which can be rendered self-emulsifiable upon neutralization.

The toner particle thus obtained was withdrawn by filtration, and then re-dispersed in water so that it was washed. The toner particle was then separated from the aqueous medium. The toner particle thus separated was then freeze-dried to obtain the desired toner powder.

The toner powder thus obtained exhibited an average particle size of 8.3 $\mu$m as determined by means of a Type 2 Coulter multicizer.

(COMPARATIVE EXAMPLE 2)

900 parts of the resin solution R-2 obtained in Reference Example and 50 parts of ELFTEX 8 (carbon black produced by Cabot Inc. of USA) were kneaded in Eiger Motor Mill M-250 (a motor mill manufactured by Eiger Japan K.K.) for 1 hour. Then, the nonvolatile content thereof was adjusted to 46% with methyl ethyl ketone to prepare a mill base (Mixture A). The mill base obtained had a solid resin content/pigment ratio of 90/10.

To 200 parts of Mixture A, 9.5 parts of a 1N aqueous sodium hydroxide solution and 29 parts of isopropyl alcohol were added. The mixture was kept at a temperature of 30° C. and then, 80 parts of deionized water (30° C) was added dropwise to the mixture while stirring to effect phase inversion emulsification. After 30 minutes, 300 parts of deionized water was further added.

Thereafter, the organic solvent was removed under reduced pressure, toner particles were separated from the processing solution by filtration, and then the particles were re-dispersed in water. The dispersion solution thus obtained was adjusted to have a pH of 2 with a 0.1N aqueous hydrochloric acid solution and then stirred for 30 minutes to convert the resin in the toner particle to a resin which can be rendered self-emulsifiable upon neutralization.

The toner particles obtained were separated by filtration and washed by the re-dispersion in water. The toner particles were separated from the aqueous medium and then freeze-dried to obtain the desired toner powder.

The thus-obtained toner had an average particle size determined by Coulter Multicizer 2, of 7.9 μm.

(EXAMPLE 1)

900 parts of the resin solution R-3 and 50 parts of ELFTEX 8 (carbon black available from Cabot Inc. of USA) were kneaded by means of Type M-250 Eiger Motor Mill (motor mill available from Eiger Japan K.K.) for 1 hour. Methyl ethyl ketone was then added to the material in an amount such that the nonvolatile content thereof was adjusted to 51% to prepare a mill base (mixture A). The ratio of solid resin content to pigment in the mill base thus obtained was 90/10.

Subsequently, to 300 parts of the mixture A were added 20.7 parts of a 1N aqueous solution of sodium hydroxide, 34 parts of isopropyl alcohol, 30 parts of methyl ethyl ketone and 90 parts of deionized water. The mixture was thoroughly stirred, and then kept at an internal temperature of 30° C. Under these conditions, deionized water was then added dropwise to the mixture with stirring to cause phase inversion emulsification. After 30 minutes, 300 parts of deionized water were added to the system. (This applies to the following examples).

The system was then subjected to distillation under reduced pressure to remove the organic solvent therefrom. A toner particle was then withdrawn from the residue by filtration, and then re-dispersed in water. Subsequently, the dispersion thus obtained was adjusted with a 0.1N aqueous solution of hydrochloric acid to pH 2. The dispersion was then stirred for 30 minutes to convert the resin in the toner particle to a resin which can be rendered self-emulsifiable upon neutralization.

The toner particle thus obtained was withdrawn by filtration, and then re-dispersed in water so that it was washed. The toner particle was then separated from the aqueous medium. The toner particle thus separated was then freeze-dried to obtain the desired toner powder.

The toner powder thus obtained exhibited an average particle size of 7.8 μm as determined by means of a Type 2 Coulter multicizer.

(EXAMPLE 2)

The procedure of Example 1 was followed to obtain a toner powder except that the resin solution R-4 was used and the granulation conditions were changed such that the amount of 1N aqueous solution of sodium hydroxide, isopropyl alcohol and methyl ethyl ketone were 16.5 parts, 37.2 parts and 51 parts, respectively.

The toner powder thus obtained exhibited an average particle size of 7.7 μm as determined by a Type 2 Coulter multicizer.

(EXAMPLE 3)

The procedure of Example 1 was followed to obtain a toner powder except that the resin solution R-5 was used and the granulation conditions were changed such that the amount of 1N aqueous solution of sodium hydroxide, isopropyl alcohol and methyl ethyl ketone were 24.8 parts, 53 parts and 90 parts, respectively.

The toner powder thus obtained exhibited an average particle size of 8.3 μm as determined by a Type 2 Coulter multicizer.

(EXAMPLE 4)

900 parts of the resin solution R-3 and 50 parts of ELFTEX 8 (carbon black available from Cabot Inc. of USA) were kneaded by means of Type M-250 Eiger Motor Mill (motor mill available from Eiger Japan K.K.) for 1 hour. The ratio of solid resin content to pigment in the mill base thus obtained was 90/10.

Subsequently, to the carbon-dispersed resin solution thus obtained were added 45 parts of a liquid medium dispersion of a finely particulate wax "H808" (emulsion type wax (Fischer-Tropsch wax) available from Chukyo Yushi Co., Ltd.; particle size: 0.5 μm; solid content: 30%). The mixture was then subjected to stirring and dispersion by means of a Type M-250 Eiger Motor Mill for 10 minutes. The nonvolatile content of the mixture was then adjusted to 51% to prepare a mill base.

Subsequently, to the mill base were added 20.7 parts of a 1N aqueous solution of sodium hydroxide (neutralizer), 34 parts of isopropyl alcohol, 30 parts of methyl ethyl ketone and 90 parts of deionized water. The mixture was thoroughly stirred, and then kept at an internal temperature of 30° C. Under these conditions, deionized water was then added dropwise to the mixture with stirring to cause phase inversion emulsification. After 30 minutes, 300 parts of deionized water were added to the system.

Thereafter, the system was processed in the same manner as in Example 1 to obtain a toner powder. The toner powder thus obtained exhibited an average particle size of 7.9 μm as determined by means of a Type 2 Coulter multicizer.

The toner particle obtained was dyed with ruthenium oxide and the cross section thereof was observed through TEM (transmission electron microscope). As a result, it was verified that a finely particulate wax and carbon black both encapsulated in the binder resin were uniformly dispersed in the toner particle. The toner particles obtained in Comparative Examples 1 and 2 and Examples 1 to 4 each was substantially spherical having an average roundness of from 0.98 to 0.99. The toner particles obtained each was substantially a true sphere having a Wadell's practical sphericity of 0.8 or more, actually of 0.95 or more.

(Toner fixability test)

To each of the freeze-dried powdered toners prepared in the foregoing examples and comparative examples was added a Type R-972 particulate silica available from Nihon Aerosil Kogyo K.K. in an amount of 0.5%. 22.5 parts of the powdered toner and 427.5 parts of a commercially available ferrite carrier were then blended. The blend thus obtained was then used to print an image on paper in such a manner that ID value reached not less than 1.5. The term "ID value" as used herein is meant to indicate an image density determined by means of a Type Macbeth RD-918 printing reflection densitometer available from Macbeth Corp. of USA. For the image printing and fixability test, an oilless type copying machine available from Ricoh Co., Ltd. (Imagio DA250) was disassembled into an image printing zone and a fixing zone which were then remodelled.

(Criterion of evaluation of fixability)

* Fixing starting temperature: A paper on which an image had been printed was passed at a rate of 130 mm/sec. over a heated roll the surface temperature of which had been properly controlled so that the image was fixed. A cellophane tape was then stuck to the image thus hot-fixed. A load of 100 g/cm$^2$ was then placed on the laminate. The cellophane tape was then peeled off the material. ID value of the image was then measured. The fixing starting temperature is represented by the surface temperature of the heated roll at which ID value of the image determined after the cellophane tape peeling test reaches not less than 90% of that before the test.

* Anti-hot offset temperature: A paper on which an image had been printed was passed at a rate of 130 mm/sec. over a heated roll (silicone oil-free type) the surface temperature of which had been properly controlled. The temperature at which hot offset occurs is the hot offset generating temperature. The anti-hot offset temperature is represented by the temperature at which hot offset is about to occur.

* Anti-curling property: A paper on which an image had been printed was passed at a rate of 130 mm/sec. over a heated roll the surface temperature of which had been properly controlled. During this process, the curling of the paper to the heated roll was observed. When no curling occurs, the anti-curling property of the toner is regarded as o. When the paper warps, the anti-curling property of the toner is regarded as Δ. When the paper is wound on the heated roll, the anti-curling property of the toner is regarded as x.

The evaluation of fixing starting temperature, anti-hot offset temperature and anti-curling property was effected every 5° C. up to 220° C.

(Criterion of evaluation of storage stability)

For the evaluation of storage stability, 5 g of the toner was allowed to stand at a temperature of 50° C. in a 50 cc glass sample bottle for 7 days. The temperature of the sample was then returned to room temperature. The sample bottle was then inverted. The samples in which the content had dropped through inside the bottle within 10 seconds were considered acceptable. At the same time, the agglomeratability of the toner was evaluated and represented in accordance with a 5-step criterion (5: no agglomeration; 1: remarkable agglomeration).

(Criterion of evaluation of granulating properties)

The problem confronted when the high molecular weight polymer is used is whether or not the form of the particulate material is good. A particulate material in a good form looks spherical and deep-black when observed under an optical microscope. On the contrary, a particulate material in a bad form has agglomerated carbon and looks unevenly transparent when observed under an optical microscope. Such a bad form exhibits a smaller bulk specific gravity than normal form. Further, such a bad form is disadvantageous in that it provides a toner having a deteriorated storage stability or durability. A normal particulate material is regarded as o. A particulate material having some unevenness around particles is regarded as Δ. A particulate material having a remarkable unevenness is regarded as x. Further, the bulk specific gravity (g/cm$^3$; having the same meaning as the aerated bulk density; when toners placed in a sieve were fallen into a standing vessel while vibrating to fill the vessel, a numeral obtained by dividing the toner weight in the vessel by the inner volume of the vessel)) is also shown. The bulk specific gravity (aerated bulk density) was measured after externally adding 0.5% of R972. The bulk specific gravity measured before the addition of R972 was from 0.25 to less than 0.35 for any primary body toner of Examples and 0.19 for the primary body toner of Comparative Example 1. The evaluation results are shown in Tables 2 and 3.

TABLE 2

| | Comparative Example 1 | Comparative Example 2 | Example 1 |
|---|---|---|---|
| Granulating properties | | | |
| Particle form | ○ | X | ○ |
| Aerated bulk density | 0.412 | 0.318 | 0.423 |
| Fixing characteristics | | | |
| Fixing initiation temperature (°C.) | 165 | 140 | 120 |
| Hot-offset generating temperature (°C.) | 190 | 180 | 195 |
| Anti-curling property | X | X | Δ |
| Storage stability | acceptable (5) | acceptable (3) | acceptable (5) |
| Tg (°C.) | 75 | 62 | 61 |

TABLE 3

| | Example 2 | Example 3 | Example 4 |
|---|---|---|---|
| Granulating properties | | | |
| Particle form | ○ | ○ | ○ |
| Aerated bulk density | 0.421 | 0.433 | 0.411 |
| Fixing characteristics | | | |
| Fixing initiation temperature (°C.) | 130 | 125 | 120 |
| Hot-offset generating temperature (°C.) | 190 | 200 | >220 |
| Anti-curling property | Δ | Δ | ○ |
| Storage stability | acceptable (4) | acceptable (5) | acceptable (5) |
| Tg (°C.) | 62 | 62 | 61 |

In Comparative Example 1 where a toner prepared according to the conventional technique (JP-A-5-66600), containing less than 4% of components having a molecular weight in terms of polystyrene by GPC of 200,000 or more, and having a Mw/Mn ratio of 3 was used, the fixing initiation temperature was high of 165° C., the hot-offset generating temperature was low of 190° C. and the curling property to the fixing roll was strong.

In Comparative Example 2 where the Tg was lower than that in Comparative Example 1, the fixing initiation temperature was somewhat lowered but the hot-offset generating temperature was also lowered and the fixing property was not improved. Moreover, in Comparative Example 2, the granulating properties were conspicuously reduced. As verified thus, the toners prepared according to the conventional technique are limited in the practical capabilities.

On the other hand, in any of Examples 1 to 3 using an in-situ resin containing 5% or more of the components having a molecular weight in terms of polystyrene by GPC of 200,000 or more, and having a Mw/Mn ratio of 4 or more, the fixing initiation temperature was greatly reduced, the hot-offset generating temperature was slightly elevated and the anti-curling property to the fixing roll was improved, as compared with Comparative Example 1.

In Example 4 using a toner obtained by further adding a wax to the in-situ resin, the fixing initiation temperature was low, the hot-offset generating temperature was greatly elevated, the curling property to the fixing roller was not observed at all, and sufficiently high capabilities were exhibited with respect to all physical properties such as particle shape, aerated bulk density and storage stability.

The external addition of the present invention is described below by referring to the Examples.

EXAMPLE 5

5 parts of trifluoropropyltrimethoxysilane $CF_3—C_2H_4—Si(OCH_3)_3$ was dissolved in 200 parts of methanol, and thereto, 50 parts of titanium oxide MT-150 (produced by Tayca Corporation) having an average primary particle size of about 15 nm was added. After thorough dispersion under stirring, the methanol solvent was removed by distillation and the residual mixture was heat-treated at about 120° C. and then crushed to prepare titanium oxide fine particles each surface-treated with an organic compound having a trifluoromethyl group.

To 100 parts of the spherical toner particles before the external addition formed in Example 4, 1 part of the titanium oxide fine particles prepared above and 0.3 part of hydrophobic silica AEROSIL R972 (produced by Nippon Aerosil Co., Ltd.) were externally added using a Henschel mixer to prepare a toner.

(Evaluation of environmental stability)

3 parts of a toner and 97 parts of a silicon resin-coat ferrite carrier (produced by Powder Teck) having an average particle size of 80 μm were exposed to HH (high temperature and high humidity conditions, 35° C.—85%) or LL (low temperature and low humidity conditions, 10° C.—15%) for about 12 hours and then mixed in a ball mill for 30 minutes. The charge amount of the mixture was measured by the blowoff method (using a charge amount measuring device manufactured by Toshiba Chemical) and the ratio of (charge amount under HH)/(charge amount under LL) was used as an index for the environmental stability.

(Evaluation of charge rising property)

3 parts of a toner and 97 parts of a silicon resin-coat ferrite carrier described above were mixed in a ball mill and the charge amount at the mixing time of 1 minute or 30 minutes was measured by the blowoff method.

(Evaluation of uniformity of charge amount distribution)

The reverse charge ratio of the developer was measured using E-SPART analyzer (manufactured by Hosokawa Micron Corporation).

TABLE 4

| | Charge Amount by Blowoff (μC/g) | | Reverse Charge Ratio (% by number) | | Environmental |
|---|---|---|---|---|---|
| | mixing for 1 min | mixing for 30 min | mixing for 1 min | mixing for 30 min | Stability HH/LL |
| Example 5 | −38.3 | −39.6 | 3.6 | 2.5 | 0.82 |
| Example 4 | −26.2 | −31.0 | 16.0 | 12.3 | 0.48 |

The toner of Example 5 where a titanium oxide fine particle surface-treated with an organic compound having a trifluoromethyl group was externally added was greatly improved in the environmental stability and also exhibited very good results with respect to the charge rising and the uniformity of charging, as compared with the toner of Example 4 having externally added thereto only silica.

When an image was formed using the toner of Example 5 in a copying machine Imagio MF530, manufactured by Ricoh Company, Ltd., employing a two-component development system or in a laser printer 4019, manufactured by IBM Ltd., employing a non-magnetic one-component development system, high-quality images having an image density of from 1.5 to 1.6 were obtained.

EXAMPLE 6

To 100 parts of spherical toner particles (before external addition) of Example 4, 0.3 part of electrically conductive titanium oxide EC-300 (produced by Titan Kogyo K. K.) and 0.5 part of hydrophobic silica AEROSIL R972 (produced by Nippon Aerosil Co., Ltd.) were externally added using a Henschel mixer to prepare a toner.

EXAMPLE 7

To 100 parts of spherical toner particles (before external addition) of Example 4, only 0.5 part of electrically conductive titanium oxide EC-300 was externally added using a Henschel mixer to prepare a toner.

The toners of Examples 6 and 7 were measured on the triboelectricity by the method described above and the results obtained are shown in Table 5.

TABLE 5

| | Charge Amount by Blowoff (μC/g) | | Reverse Charge Ratio (% by number) | | Environmental |
|---|---|---|---|---|---|
| | mixing for 1 min | mixing for 30 min | mixing for 1 min | mixing for 30 min | Stability HH/LL |
| Example 6 | −27.6 | −28.1 | 2.3 | 1.9 | 0.55 |
| Example 7 | −14.3 | −20.1 | 31.0 | 21.3 | 0.51 |

The toner to which an electrically conductive fine particle and a silica fine particle both were externally added was improved in the charge rising property and the uniformity of charging as compared with the toner of Example 4 having externally added thereto only a silica fine particle or the toner of Example 7 having externally added thereto only an electrically conductive fine particle.

In the image formation test in a copying machine, a high-quality image having an image density of from 1.5 to 1.6 and free of fog was obtained when the toner of example 6 was used. On the other hand, when the tone of Example 7 was used, the image density was low of 0.9 and fog was heavily formed.

In the image formation test in a printer, a high-quality image having an image density of from 1.5 to 1.6 and free of fog was obtained when the toner of example 6 was used. On the other hand, when the tone of Example 7 was used, the image density was fairly low of 1.0 and fog was very heavily formed.

The first invention and the second invention of the present invention use as the binder resin a non-crosslinked styrene-acrylic resin containing from 5 to 60% by weight of the components having a molecular weight in terms of polystyrene by GPC of 200,000 or more, and having a ratio (Mw/Mn) of the weight-average molecular weight Mw to the number-average molecular weight Mn of from 4 to 30 and an acid value of from 30 to 120, and thereby, an effect that the fixing property is very greatly improved, is offered.

According to the present invention in a more optimized embodiment, an electrophotographic toner suitable either for two-component development or for one-component development is provided, which has capabilities that (1) since the styrene-acrylic resin as the binder resin is controlled to have a molecular weight of a specific range and a wax is contained, the toner can have very excellent heated roll fixing property, (2) since the shape is spherical and void is absent within the particle, the toner is excellent in the fluidity and mechanical strength, and (3) since the binder resin is a high acid value resin, the toner has good triboelectricity even without containing a CCA. Further, by externally adding a metal oxide fine particle of the present invention, the toner can be greatly improved in the environmental stability and the charge rising property.

What is claimed is:

1. An electrophotographic toner which is a spherical particle comprising a binder resin having encapsulated therein a colorant and has a volume average particle size of from 3 to 12 $\mu$m, said binder resin being a non-crosslinked styrene-acrylic resin having an acid value of from 30 to 120, said resin containing from 5 to 60% by weight of the components having a molecular weight in terms of polystyrene by gel permeation chromatography of 200,000 or more and said resin having a ratio (Mw/Mn) of the weight-average molecular weight Mw to the number-average molecular weight Mn of from 4 to 30.

2. The electrophotographic toner as claimed in claim 1, wherein the non-crosslinked styrene-acrylic resin having an acid value of from 30 to 120 as the binder resin contains from 10 to 60% by weight of the components having a molecular weight in terms of polystyrene by gel permeation chromatography of 200,000, said resin has a ratio (Mw/Mn) of the weight-average molecular weight Mw to the number-average molecular weight Mn of from 4 to 30, and the volume average particle size is from 3 to 12 $\mu$m.

3. The electrophotographic toner as claimed in claim 1, wherein the spherical particle is a spherical particle having an average roundness of 0.97 or more, the non-crosslinked styrene-acyl resin having an acid value of from 30 to 120 as the binder resin contains from 10 to 60% by weight of the components having a molecular weight in terms of polystyrene by gel permeation chromatography of 200,000 or more, and the toner has an aerated bulk density of 0.35 g/cm$^3$ or more.

4. The electrophotographic toner as claimed in claim 1, wherein the spherical particle is a particle comprising a binder resin having encapsulated therein a wax fine particle together with a colorant.

5. The electrophotographic toner as claimed in claim 1, wherein a metal oxide fine particle surface-treated with an organic compound having a trifluoromethyl group is externally added.

6. The electrophotographic toner as claimed in claim 5, wherein the metal oxide fine particle is titanium oxide having an average particle size of from 5 to 100 nm.

7. The electrophotographic toner as claimed in claim 1, wherein an electrically conductive fine particle and a hydrophobic silica fine particle are externally added.

8. A process for preparing an electrophotographic toner comprising spherical particles having a volume average grain size of from 3 to 12 $\mu$m, the process comprising mixing a mixture comprising a colorant, a wax, a resin which can be rendered self-emulsifiable upon neutralization and an organic solvent as essential components with an aqueous medium in the presence of a neutralizer in an amount sufficiently large to render said resin self-emulsifiable to effect phase inversion emulsification, thereby producing particles each comprising a binder resin having encapsulated therein a colorant and a wax in the liquid medium, and separating and drying the particles, wherein said resin which can be rendered self-emulsifiable upon neutralization is a non-crosslinked styrene-acrylic resin having an acid value of from 30 to 120, and said resin contains from 5 to 60% by weight of the components having a molecular weight in terms of polystyrene by gel permeation chromatography of 200,000 or more and has a ratio (Mw/Mn) of the weight-average molecular weight Mw to the number-average molecular weight Mn of from 4 to 30.

9. The process for preparing an electrophotographic toner as claimed in claim 8, wherein the spherical particle is a spherical particle having an average roundness of 0.97 or more, the non-crosslinked styrene-acrylic resin having an acid value of from 30 to 120 as the binder resin contains from 10 to 60% by weight of the components having a molecular weight in terms of polystyrene by gel permeation chromatography of 200,000 or more, and the toner has an aerated bulk density of 0.35 g/cm$^3$ or more.

10. The preparation process as claimed in claim 8, wherein the styrene-acrylic resin is obtained by mixing two or more non-crosslinked resins compatible with each other and different in the weight-average molecular weight.

11. The preparation process as claimed in claim 8, wherein the resin which can be rendered self-emulsifiable upon neutralization is a styrene-acrylic resin having an acid value of from 30 to 120 and obtained from two or more different mixtures of addition-polymerizable monomers by in-situ polymerizing at least one mixture out of said plurality of mixtures until the polymerization rate reaches from 20 to 80% and then adding and polymerizing another mixture in the same reaction vessel, the mixtures being prepared such that at least one of the mixtures contains styrene and/or (meth)acrylic acid ester and the mixtures in total contain styrene and (meth)acrylic acid ester.

12. The preparation process as claimed in claim 8, wherein the resin which can be rendered self-emulsifiable upon neutralization is a styrene-acrylic resin which contains components having a molecular weight of from 80,000 to 500,000 or from 6,000 to 60,000, has an acid value of from 30 to 120 and is obtained from two or more different mixtures of addition-polymerizable monomers by in-situ polymerizing at least one mixture out of said plurality of mixtures until the polymerization rate reaches from 20 to 80% and then adding and polymerizing another mixture in the same reaction vessel, the mixtures being prepared such that at least one of the mixtures contains styrene and/or (meth)acrylic acid ester and the mixtures in total contain styrene and (meth)acrylic acid ester.

13. The preparation process as claimed in claim 8, wherein respective mixtures used are prepared such that the Tg of the product resin determined on the assumption that 100% of the addition-polymerizable monomers in the mixture first polymerized are reacted is lower than the Tg of the product resin determined on the assumption that 100% of the addition-polymerizable monomers in the mixture subsequently added to the same reaction vessel are reacted.

14. The preparation process as claimed in claim 8, wherein an aqueous dispersion solution of finely particulate wax each being smaller than the particle size of the toner particle to be produced is used in combination.

* * * * *